US008464628B2

(12) United States Patent
Potterfield et al.

(10) Patent No.: US 8,464,628 B2
(45) Date of Patent: Jun. 18, 2013

(54) ATTACHMENT MECHANISMS FOR COUPLING FIREARMS TO SUPPORTING STRUCTURES

(75) Inventors: Russell A. Potterfield, Columbia, MO (US); Tim Kinney, Columbia, MO (US); Dennis Cauley, Boonville, MO (US); Yan-Jiang Zhou, Columbia, MO (US)

(73) Assignee: Battenfeld Technologies, Inc., Columbia, MO (US)

( * ) Notice: Subject to any disclaimer, the term of this patent is extended or adjusted under 35 U.S.C. 154(b) by 0 days.

(21) Appl. No.: 12/916,129

(22) Filed: Oct. 29, 2010

(65) Prior Publication Data

US 2011/0036236 A1 Feb. 17, 2011

Related U.S. Application Data

(62) Division of application No. 12/209,113, filed on Sep. 11, 2008, now Pat. No. 7,845,267.

(60) Provisional application No. 60/971,507, filed on Sep. 11, 2007.

(51) Int. Cl.
*F41A 23/14* (2006.01)

(52) U.S. Cl.
USPC ..... 89/40.06; 89/37.04

(58) Field of Classification Search
USPC ..... 89/40.06, 37.03, 37.04, 37.11, 37.14
See application file for complete search history.

(56) References Cited

U.S. PATENT DOCUMENTS

| | | | |
|---|---|---|---|
| 197,397 | A | 11/1877 | O'Neil |
| 387,411 | A | 8/1888 | Gisel |
| 399,604 | A | 3/1889 | Dufner et al. |
| 499,315 | A | 6/1893 | Borchardt |
| 568,543 | A | 9/1896 | Parks |
| 668,219 | A | 2/1901 | Rock |
| 691,912 | A | 1/1902 | McClean |
| 718,865 | A | 1/1903 | Northcraft |
| 778,865 | A | 1/1905 | Hyenga |
| 789,909 | A | 5/1905 | Herold |
| 1,033,624 | A | 7/1912 | Schmeisser |
| 1,061,577 | A | 5/1913 | Whitney |
| 1,088,362 | A | 2/1914 | Perkins |
| 1,089,307 | A | 3/1914 | Benet et al. |
| 1,121,945 | A | 12/1914 | Smith |
| 1,145,585 | A | 7/1915 | Hebard |

(Continued)

FOREIGN PATENT DOCUMENTS

| | | | |
|---|---|---|---|
| DE | 838872 | C | 5/1952 |
| EP | 0624455 | A2 | 11/1994 |
| GB | 475080 | A | 11/1937 |

OTHER PUBLICATIONS

U.S. Appl. No. 11/739,077, filed Apr. 23, 2007, Cauley et al.

(Continued)

*Primary Examiner* — Stephen M Johnson

(74) *Attorney, Agent, or Firm* — Senniger Powers LLP

(57) ABSTRACT

Attachment mechanisms for attaching firearms to support structures are disclosed herein. In one embodiment, an attachment mechanism for attaching a firearm to a support structure includes an interface member coupled to a latching subassembly. The latching subassembly includes having an attachment portion and a latching arm. The attachment portion is configured to engage a connector fastened to the firearm through the aperture, and the latching arm lockably retains the attachment portion proximate to the interface member.

18 Claims, 7 Drawing Sheets

U.S. PATENT DOCUMENTS 1,175,692 A 3/1916 Boicourt
1,187,325 A 6/1916 Ivey
1,195,777 A 8/1916 Burtin
1,250,215 A 12/1917 Panos
1,256,255 A 2/1918 Porter
1,295,688 A 2/1919 Butler
1,367,353 A 2/1921 Craig
1,457,407 A 6/1923 Stokes
1,488,647 A 4/1924 Quinn
1,491,604 A 4/1924 Fuller
1,639,722 A 8/1927 Whitney
1,693,289 A 11/1928 Warren
1,736,244 A 11/1929 Baker
1,902,040 A 3/1933 Meyer
1,907,181 A 5/1933 Fey
1,927,876 A 9/1933 Meyer
1,928,871 A 10/1933 Swebilius
2,066,218 A 12/1936 Morgan
2,079,510 A 5/1937 King et al.
2,090,930 A 8/1937 Chubb
2,100,514 A 11/1937 Miller
2,121,982 A 6/1938 Pugsley
2,125,353 A 8/1938 Mattson
2,216,766 A 10/1940 Cook
2,232,743 A 2/1941 Swenson
2,297,993 A 10/1942 Tratsch
2,331,372 A 10/1943 Buchanan
2,427,365 A 3/1944 Meister
2,378,545 A 6/1945 Fraser et al.
D147,305 S 8/1947 Sloan
2,432,519 A 12/1947 Garand
2,451,266 A 10/1948 Whittemore
2,455,644 A 12/1948 Barnes
2,476,078 A 7/1949 Banks
2,479,354 A 8/1949 Hanson
2,483,089 A 9/1949 Ferguson
2,484,801 A 10/1949 Anderson
2,508,951 A 5/1950 Kazimier
2,510,380 A 6/1950 Clifford
2,517,268 A 8/1950 Wilson
2,582,140 A 1/1952 Leek
3,064,976 A 11/1952 Kuhn
2,638,676 A 5/1953 Callahan
2,677,207 A 5/1954 Stewart
2,701,930 A 2/1955 Dolan
2,729,975 A 1/1956 Hawthorne
2,731,829 A 1/1956 Wigington et al.
2,740,530 A 4/1956 Ponder
2,753,642 A 7/1956 Sullivan
2,774,090 A 12/1956 Allinson
2,774,563 A 12/1956 Pribis
2,795,881 A 6/1957 Bellows
2,813,376 A 11/1957 Middlemark
2,817,233 A 12/1957 Dower et al.
2,821,117 A 1/1958 Hultgren
2,847,909 A 8/1958 Kester
2,867,931 A 1/1959 Schreiber
2,874,707 A 2/1959 Koppel
2,877,689 A 3/1959 Pribis
2,894,347 A 7/1959 Woodcock
2,924,881 A 2/1960 Gee
2,924,904 A 2/1960 Amsler
2,924,914 A 2/1960 Garwood
2,975,540 A 3/1961 Lewis
2,999,788 A 9/1961 Morgan
3,011,283 A 12/1961 Lunn et al.
3,012,350 A 12/1961 Wold
3,013,289 A 12/1961 Sasena
3,023,527 A 3/1962 Leek et al.
3,024,653 A 3/1962 Broadway
3,041,938 A 7/1962 Seabrook
3,055,655 A 9/1962 Chelf
3,060,612 A 10/1962 Brown et al.
3,107,642 A 10/1963 Lakin
3,112,567 A 12/1963 Flanagan
3,125,929 A 3/1964 Peasley
3,128,668 A 4/1964 Dicken
3,137,957 A 6/1964 Ingalls
3,163,420 A 12/1964 Braun
3,175,456 A 3/1965 Goodsell
3,183,617 A 5/1965 Ruger et al.
3,205,518 A 9/1965 Romaine
3,206,885 A 9/1965 Dye
3,225,656 A 12/1965 Flaherty et al.
D203,680 S 2/1966 Allison
3,240,103 A 3/1966 Lamont
3,259,986 A 7/1966 Carr
3,283,425 A 11/1966 Boyd
3,283,643 A 11/1966 Mittelsteadt
3,291,317 A 12/1966 Bowen
3,292,293 A 12/1966 Chiasera et al.
3,320,848 A 5/1967 Ponsness
3,323,246 A 6/1967 Loffler
3,327,422 A * 6/1967 Harris ..... 42/94
3,330,561 A 7/1967 Kandel
3,343,411 A 9/1967 Lee
3,353,827 A 11/1967 Dun, Jr.
3,358,504 A 12/1967 Freebairn
3,370,852 A 2/1968 Kandel
3,406,969 A 10/1968 Tisdell et al.
3,423,092 A 1/1969 Kandel
D215,311 S 9/1969 Born
3,486,752 A 12/1969 Colvin
3,499,525 A 3/1970 Kanter
3,510,951 A 5/1970 Dow
3,513,604 A 5/1970 Matsunaga et al.
3,536,160 A 10/1970 Brewer
3,550,941 A 12/1970 Spiro et al.
3,556,666 A 1/1971 Lichenstern
D220,154 S 3/1971 Irelan
3,572,712 A 3/1971 Vick
3,580,127 A 5/1971 Lee
3,736,243 A 5/1971 Duggan
3,583,556 A 6/1971 Wagner
3,584,820 A 6/1971 Butcher, Sr.
3,587,193 A 6/1971 Lewis
3,608,225 A 9/1971 Manuel
3,609,902 A 10/1971 Casull
3,646,704 A 3/1972 Ellsworth
3,648,909 A 3/1972 Wisecarver
3,680,266 A 8/1972 Shiplov
3,680,354 A 8/1972 Phillips, Jr.
3,711,955 A 1/1973 Holt
3,711,984 A 1/1973 Dyer et al.
3,738,101 A 6/1973 Simon-Vermot
3,739,515 A 6/1973 Koon, Jr.
3,743,088 A 7/1973 Henkin
3,744,292 A 7/1973 Michelson
3,745,875 A 7/1973 Kennedy et al.
3,748,950 A 7/1973 Huntington
3,764,219 A 10/1973 Collins
3,769,758 A 11/1973 McDonald
3,771,176 A 11/1973 Herman
3,804,238 A 4/1974 Howard
3,813,816 A 6/1974 Funk
3,815,270 A 6/1974 Pachmayr
3,826,559 A 7/1974 Berliner et al.
3,827,172 A 8/1974 Howe
3,842,527 A 10/1974 Low
D233,853 S 12/1974 Ferrara
3,876,078 A 4/1975 Gomes et al.
3,877,178 A 4/1975 Campanelli
3,878,939 A 4/1975 Wilcox
3,885,357 A 5/1975 Hoyt
3,893,266 A 7/1975 Anderson et al.
3,895,803 A 7/1975 Loe
3,899,175 A 8/1975 Loe
3,899,797 A 8/1975 Gunst
D237,106 S 10/1975 Baljet et al.
3,913,746 A 10/1975 Burton
3,914,879 A 10/1975 Taylor, III et al.
3,935,657 A 2/1976 Wade
3,947,988 A 4/1976 Besaw
3,949,987 A 4/1976 Candor
3,961,436 A 6/1976 Hagen et al.
3,964,613 A 6/1976 Anderson, Jr.
3,979,849 A 9/1976 Haskins 4,007,554 A 2/1977 Helmstadter
4,012,860 A 3/1977 Auger
4,021,971 A 5/1977 McFadden
4,026,057 A 5/1977 Cady
4,027,781 A 6/1977 Covert
4,042,242 A 8/1977 Nicholls et al.
4,054,288 A 10/1977 Perrine, Sr.
4,055,016 A 10/1977 Katsenes
4,072,313 A 2/1978 Murso et al.
4,076,247 A 2/1978 Kim et al.
4,090,606 A 5/1978 Dawson
4,120,108 A 10/1978 Vickers et al.
4,120,276 A 10/1978 Curran
4,122,623 A 10/1978 Stice
4,143,491 A 3/1979 Blanc
4,177,608 A 12/1979 Balz
4,188,855 A 2/1980 Alberts
4,203,600 A 5/1980 Brown
4,206,573 A 6/1980 Hayward
4,222,305 A 9/1980 Lee
4,223,588 A 9/1980 Simpson
4,233,748 A 11/1980 Ford et al.
D257,687 S 12/1980 Bechtel
4,266,748 A 5/1981 Dalton
4,266,780 A 5/1981 McQuary
4,282,671 A 8/1981 Wood et al.
D260,650 S 9/1981 Alviti
D261,794 S 11/1981 Bechtel
4,301,625 A 11/1981 Rampe
4,312,146 A 1/1982 Koon, Jr.
4,332,185 A 6/1982 Hargrove
4,333,385 A 6/1982 Culver
4,338,726 A 7/1982 Swailes
4,340,370 A 7/1982 Marshall et al.
4,345,398 A 8/1982 Pickett
4,346,530 A 8/1982 Stewart et al.
4,359,833 A 11/1982 Pachmayr et al.
4,361,989 A 12/1982 Ohno
4,385,464 A 5/1983 Casull
4,385,545 A 5/1983 Duer
4,391,058 A 7/1983 Casull
4,392,321 A 7/1983 Bosworth
4,407,379 A 10/1983 Pryor et al.
4,409,751 A 10/1983 Goda et al.
4,409,826 A 10/1983 Wenger
4,426,085 A 1/1984 Dixon
4,438,913 A 3/1984 Hylla
4,449,314 A 5/1984 Sorensen
4,462,598 A 7/1984 Chalin et al.
4,477,082 A 10/1984 McKenzie et al.
4,480,411 A 11/1984 Balz et al.
4,506,466 A 3/1985 Hall
4,508,508 A 4/1985 Theodore
4,512,101 A 4/1985 Waterman, Jr.
4,522,102 A 6/1985 Pickens
4,526,084 A 7/1985 David et al.
4,540,182 A 9/1985 Clement
4,542,677 A 9/1985 Lee
4,548,392 A 10/1985 Rickling
4,558,531 A 12/1985 Kilby
D283,561 S 4/1986 Geist
4,601,124 A 7/1986 Brown, Jr.
4,608,762 A 9/1986 Varner
4,621,563 A 11/1986 Poiencot
4,625,620 A 12/1986 Harris
4,632,008 A 12/1986 Horner
4,644,987 A 2/1987 Kiang et al.
4,648,191 A 3/1987 Goff et al.
4,653,210 A 3/1987 Poff, Jr.
4,671,364 A 6/1987 Fink et al.
4,674,216 A 6/1987 Ruger et al.
4,695,060 A 9/1987 Pilgrim
4,696,356 A 9/1987 Ellion et al.
4,702,029 A 10/1987 DeVaul et al.
4,715,499 A 12/1987 Howard
4,716,673 A 1/1988 Williams et al.
4,721,205 A 1/1988 Burt et al.
4,723,472 A 2/1988 Lee
4,729,186 A 3/1988 Rieger et al.
4,732,394 A 3/1988 Stein et al.
4,736,843 A 4/1988 Leonard
4,739,996 A 4/1988 Vedder
4,751,963 A 6/1988 Bui et al.
D297,855 S 9/1988 Ruger et al.
4,776,471 A 10/1988 Elkins
4,790,079 A 12/1988 Meyers
4,790,096 A 12/1988 Gibson et al.
4,799,324 A 1/1989 Nodo
4,807,381 A 2/1989 Southard
4,807,888 A 2/1989 Pidde et al.
4,815,593 A 3/1989 Brown
4,819,359 A 4/1989 Bassett
4,821,422 A 4/1989 Porter
4,821,443 A 4/1989 Bianco
4,823,673 A 4/1989 Downing
4,824,086 A 4/1989 Rickling et al.
4,841,839 A 6/1989 Stuart
4,850,151 A 7/1989 Ditscherlein
4,854,066 A 8/1989 Canterbury, Sr.
4,862,567 A 9/1989 Beebe
D304,223 S 10/1989 Ruger et al.
4,873,777 A 10/1989 Southard
4,890,406 A 1/1990 French
4,890,847 A 1/1990 Cartee et al.
4,896,446 A 1/1990 Gregory
D306,234 S 2/1990 Ferstl
4,903,425 A 2/1990 Harris
4,910,904 A 3/1990 Rose
4,918,825 A 4/1990 Lesh et al.
4,921,256 A 5/1990 Gearhart
4,923,402 A 5/1990 Marshall et al.
4,924,616 A 5/1990 Bell et al.
4,937,965 A 7/1990 Narvaez
D310,302 S 9/1990 Southard
4,967,497 A 11/1990 Yakscoe
4,971,208 A 11/1990 Reinfried, Jr. et al.
4,972,619 A 11/1990 Eckert
4,979,752 A 12/1990 Fosseen
D313,886 S 1/1991 Southard
4,987,694 A 1/1991 Lombardo
4,998,367 A 3/1991 Leibowitz
4,998,944 A 3/1991 Lund
5,005,657 A 4/1991 Ellion et al.
5,009,021 A 4/1991 Nelson
5,014,793 A 5/1991 Germanton et al.
5,031,348 A 7/1991 Carey
5,050,330 A 9/1991 Pilgrim et al.
5,058,302 A 10/1991 Minneman
5,060,410 A 10/1991 Mueller
5,063,679 A 11/1991 Schwandt
5,067,268 A 11/1991 Ransom
5,070,636 A 12/1991 Mueller
5,074,188 A 12/1991 Harris
5,081,783 A 1/1992 Jarvis
5,117,850 A 6/1992 Money
5,123,194 A 6/1992 Mason
5,125,389 A 6/1992 Paff
5,143,340 A 9/1992 Wood et al.
5,149,900 A 9/1992 Buck
5,173,563 A 12/1992 Gray
5,180,874 A 1/1993 Troncoso
5,185,927 A 2/1993 Rivers
5,186,468 A 2/1993 Davies
5,188,371 A 2/1993 Edwards
5,194,678 A 3/1993 Kramer
D335,896 S 5/1993 Evenson
5,211,404 A 5/1993 Grant
5,221,806 A 6/1993 Chaney et al.
5,222,306 A 6/1993 Neumann
5,228,887 A 7/1993 Mayer et al.
5,232,227 A 8/1993 Bateman
5,233,779 A 8/1993 Shaw
5,235,764 A 8/1993 Perazzi et al.
5,237,778 A 8/1993 Baer
5,247,758 A 9/1993 Mason
5,271,175 A 12/1993 West, III
5,275,890 A 1/1994 Wolf et al.
5,287,643 A 2/1994 Arizpe-Gilmore

| | | | |
|---|---|---|---|
| 5,311,693 | A | 5/1994 | Underwood |
| 5,315,781 | A | 5/1994 | Beisner |
| 5,316,579 | A | 5/1994 | McMillan et al. |
| 5,317,826 | A | 6/1994 | Underwood |
| 5,320,217 | A | 6/1994 | Lenarz |
| 5,320,223 | A | 6/1994 | Allen |
| 5,328,029 | A | 7/1994 | Chow et al. |
| 5,332,185 | A | 7/1994 | Walker, III |
| 5,333,829 | A | 8/1994 | Bell et al. |
| 5,335,578 | A | 8/1994 | Lorden et al. |
| 5,337,505 | A | 8/1994 | Brown et al. |
| 5,344,012 | A | 9/1994 | Matthews |
| 5,347,740 | A | 9/1994 | Rather et al. |
| 5,351,428 | A | 10/1994 | Graham |
| 5,358,254 | A | 10/1994 | Yeh et al. |
| 5,361,505 | A | 11/1994 | Faughn |
| 5,367,232 | A | 11/1994 | Netherton et al. |
| 5,370,240 | A | 12/1994 | Hand |
| 5,375,337 | A | 12/1994 | Butler |
| 5,375,377 | A | 12/1994 | Kenton |
| 5,377,437 | A | 1/1995 | Underwood |
| 5,392,553 | A | 2/1995 | Carey |
| 5,394,983 | A | 3/1995 | Latulippe et al. |
| 5,402,595 | A | 4/1995 | Tamllos |
| 5,406,733 | A | 4/1995 | Tarlton et al. |
| 5,410,833 | A | 5/1995 | Paterson |
| 5,414,949 | A | 5/1995 | Peebles |
| D359,392 | S | 6/1995 | Bellington |
| 5,421,115 | A | 6/1995 | McKay |
| 5,433,010 | A | 7/1995 | Bell |
| 5,433,451 | A | 7/1995 | De Vries |
| 5,435,223 | A | 7/1995 | Blodgett et al. |
| 5,442,860 | A | 8/1995 | Palmer |
| D362,116 | S | 9/1995 | Bellington et al. |
| 5,446,987 | A | 9/1995 | Lee et al. |
| D364,080 | S | 11/1995 | Weyrauch |
| 5,481,817 | A | 1/1996 | Parker |
| 5,482,241 | A | 1/1996 | Oglesby |
| 5,486,135 | A | 1/1996 | Arpaio |
| 5,490,302 | A | 2/1996 | Dion |
| 5,491,921 | A | 2/1996 | Allen |
| 5,497,557 | A | 3/1996 | Martinsson et al. |
| 5,497,575 | A | 3/1996 | Fried et al. |
| 5,501,467 | A | 3/1996 | Kandel |
| D369,904 | S | 5/1996 | Taylor |
| 5,525,314 | A | 6/1996 | Hurson |
| 5,540,329 | A | 7/1996 | Vogeley |
| 5,545,855 | A | 8/1996 | Stanfield et al. |
| 5,562,208 | A | 10/1996 | Hasler et al. |
| D375,538 | S | 11/1996 | Minneman |
| 5,570,513 | A | 11/1996 | Peterson |
| 5,580,063 | A | 12/1996 | Edwards |
| 5,588,242 | A | 12/1996 | Hughes |
| 5,600,913 | A | 2/1997 | Minneman |
| 5,617,666 | A | 4/1997 | Scott |
| 5,622,344 | A | 4/1997 | Gracie |
| 5,628,135 | A | 5/1997 | Cady |
| D380,116 | S | 6/1997 | Minneman |
| 5,640,944 | A | 6/1997 | Minneman |
| 5,644,862 | A | 7/1997 | Folmer |
| 5,649,465 | A | 7/1997 | Beebe |
| 5,651,207 | A | 7/1997 | Knight |
| 5,653,625 | A | 8/1997 | Pierce et al. |
| 5,661,919 | A | 9/1997 | Pryor |
| 5,662,516 | A | 9/1997 | You |
| 5,666,757 | A | 9/1997 | Helmstadter |
| D387,123 | S | 12/1997 | Hughes et al. |
| 5,703,317 | A | 12/1997 | Levilly et al. |
| 5,704,482 | A | 1/1998 | Apps et al. |
| 5,711,102 | A | 1/1998 | Plaster et al. |
| 5,711,103 | A | 1/1998 | Keng |
| 5,715,625 | A | 2/1998 | West, III |
| D391,616 | S | 3/1998 | Plybon |
| 5,723,183 | A | 3/1998 | Williams et al. |
| 5,723,806 | A | 3/1998 | Odom |
| 5,725,096 | A | 3/1998 | Winnard |
| 5,737,865 | A | 4/1998 | Brandl et al. |
| 5,740,625 | A | 4/1998 | Jenkins |
| 5,743,395 | A | 4/1998 | Backer |
| 5,758,447 | A | 6/1998 | Venetz |
| 5,758,933 | A | 6/1998 | Clendening |
| 5,761,954 | A | 6/1998 | Dvorak |
| 5,778,589 | A | 7/1998 | Teague |
| 5,779,527 | A | 7/1998 | Maebashi |
| 5,811,720 | A | 9/1998 | Quinnell et al. |
| 5,813,131 | A | 9/1998 | Werre |
| 5,815,974 | A | 10/1998 | Keng |
| 5,833,308 | A | 11/1998 | Strong, III et al. |
| D403,176 | S | 12/1998 | Harper |
| 5,845,774 | A | 12/1998 | Hausknecht |
| 5,857,279 | A | 1/1999 | de Oliveira Masina et al. |
| 5,875,580 | A | 3/1999 | Hill et al. |
| 5,878,504 | A | 3/1999 | Harms |
| 5,884,966 | A | 3/1999 | Hill et al. |
| 5,899,329 | A | 5/1999 | Hu et al. |
| 5,907,919 | A | 6/1999 | Keeney |
| 5,913,422 | A | 6/1999 | Cote |
| 5,913,667 | A | 6/1999 | Smilee |
| 5,913,668 | A | 6/1999 | Messer |
| 5,924,694 | A | 7/1999 | Kent |
| 5,930,932 | A | 8/1999 | Peterson |
| 5,933,997 | A | 8/1999 | Barrett |
| 5,933,999 | A | 8/1999 | McClure et al. |
| 5,959,613 | A | 9/1999 | Rosenberg et al. |
| 5,970,642 | A | 10/1999 | Martin |
| 5,974,719 | A | 11/1999 | Simonek |
| 6,019,375 | A | 2/2000 | West, Jr. |
| 6,021,891 | A | 2/2000 | Anderson |
| 6,032,796 | A | 3/2000 | Hopper |
| 6,042,080 | A | 3/2000 | Shepherd et al. |
| 6,044,747 | A | 4/2000 | Felts |
| 6,058,641 | A | 5/2000 | Vecqueray |
| 6,073,381 | A | 6/2000 | Farrar et al. |
| 6,086,375 | A | 7/2000 | Legros |
| 6,092,662 | A | 7/2000 | Frederick, Jr. |
| 6,110,020 | A | 8/2000 | Rolfi |
| 6,121,556 | A | 9/2000 | Cole |
| 6,237,462 | B1 | 5/2001 | Hawkes et al. |
| 6,254,100 | B1 | 7/2001 | Rinehart |
| 6,260,463 | B1 | 7/2001 | Brand et al. |
| 6,269,578 | B1 | 8/2001 | Callegari |
| 6,283,428 | B1 | 9/2001 | Maples et al. |
| 6,289,622 | B1 | 9/2001 | Desch, Jr. et al. |
| 6,293,041 | B2 | 9/2001 | Weaver |
| 6,294,759 | B1 | 9/2001 | Dunn, Jr. |
| 6,305,117 | B1 | 10/2001 | Hales, Sr. |
| 6,309,476 | B1 | 10/2001 | Ravenscroft et al. |
| 6,338,218 | B1 | 1/2002 | Hegler |
| 6,390,294 | B1 | 5/2002 | Fiore, Jr. et al. |
| 6,397,720 | B1 | 6/2002 | Fox et al. |
| 6,439,515 | B1 | 8/2002 | Powers |
| 6,439,530 | B1 | 8/2002 | Schoenfish et al. |
| 6,517,133 | B2 | 2/2003 | Seegmiller et al. |
| D471,248 | S | 3/2003 | Jacobs |
| 6,526,687 | B1 | 3/2003 | Looney |
| D473,376 | S | 4/2003 | Abate |
| 6,546,662 | B1 | 4/2003 | Chong |
| 6,557,855 | B2 | 5/2003 | Wu |
| 6,574,899 | B1 | 6/2003 | Mostello |
| 6,575,469 | B2 | 6/2003 | Love |
| 6,643,973 | B1 | 11/2003 | Smith |
| 6,663,298 | B2 | 12/2003 | Haney |
| 6,688,031 | B2 | 2/2004 | Steele |
| 6,733,375 | B2 | 5/2004 | Hoffman |
| 6,736,400 | B1 | 5/2004 | Cesternino |
| 6,813,855 | B2 | 11/2004 | Pinkley |
| 6,814,654 | B2 | 11/2004 | Rolfi |
| 6,854,975 | B2 | 2/2005 | Ranzinger |
| 6,860,054 | B1 | 3/2005 | Mosher |
| 6,862,833 | B1 | 3/2005 | Gurtner |
| 6,871,440 | B2 | 3/2005 | Highfill et al. |
| 6,877,266 | B1 | 4/2005 | Brownlee |
| 6,883,263 | B1 | 4/2005 | Carrow |
| 6,931,777 | B1 | 8/2005 | Krien |
| 6,953,114 | B2 | 10/2005 | Wang et al. |
| D513,055 | S | 12/2005 | Lahti |
| 6,978,569 | B2 | 12/2005 | Williamson, IV et al. |
| D519,183 | S | 4/2006 | Minneman |

| | | | |
|---|---|---|---|
| 7,032,494 | B2 | 4/2006 | Wygant |
| D521,100 | S | 5/2006 | Morrow |
| 7,062,979 | B2 | 6/2006 | Day et al. |
| D524,541 | S | 7/2006 | Cauley |
| 7,086,192 | B2 | 8/2006 | Deros |
| 7,104,398 | B1 | 9/2006 | Wisecarver |
| 7,134,663 | B1 | 11/2006 | Lowe et al. |
| 7,143,986 | B1 | 12/2006 | Austin et al. |
| 7,152,355 | B2 | 12/2006 | Fitzpatrick et al. |
| 7,152,358 | B1 | 12/2006 | LeAnna et al. |
| 7,159,711 | B1 | 1/2007 | Gardner |
| 7,165,750 | B2 | 1/2007 | McCuskey et al. |
| 7,188,445 | B2 | 3/2007 | Lehman |
| D540,904 | S | 4/2007 | Werner |
| 7,201,376 | B2 | 4/2007 | Kuosa |
| 7,207,567 | B1 | 4/2007 | Brown |
| D543,604 | S | 5/2007 | Minneman |
| 7,213,494 | B2 | 5/2007 | James |
| 7,225,050 | B2 | 5/2007 | Sutula, Jr. |
| D553,219 | S | 10/2007 | Potterfield |
| 7,281,346 | B1 | 10/2007 | Cook et al. |
| D567,895 | S | 4/2008 | Cauley |
| 7,356,960 | B1 | 4/2008 | Knitt |
| 7,356,961 | B2 | 4/2008 | Williams |
| 7,357,250 | B2 | 4/2008 | Hagemann et al. |
| 7,363,740 | B2 | 4/2008 | Kincel |
| 7,367,451 | B2 | 5/2008 | Pendergraph et al. |
| 7,401,431 | B2 | 7/2008 | Pierce et al. |
| 7,410,053 | B2 | 8/2008 | Bowen et al. |
| D576,245 | S | 9/2008 | Potterfield et al. |
| 7,421,815 | B1 | 9/2008 | Moody et al. |
| 7,426,800 | B2 | 9/2008 | Pierce et al. |
| 7,431,247 | B2 * | 10/2008 | Bobro ..... 248/178.1 |
| 7,536,820 | B2 | 5/2009 | Wade et al. |
| 7,549,247 | B1 | 6/2009 | Reese |
| 7,584,690 | B2 | 9/2009 | Cauley |
| D605,246 | S | 12/2009 | Hobbs |
| 7,631,455 | B2 | 12/2009 | Keng et al. |
| 7,654,498 | B1 | 2/2010 | Beltz |
| 7,665,241 | B2 | 2/2010 | Oz |
| 7,676,977 | B1 | 3/2010 | Cahill et al. |
| 7,681,886 | B2 | 3/2010 | Morrow et al. |
| 7,694,973 | B1 | 4/2010 | Hofmeister et al. |
| 7,726,478 | B2 | 6/2010 | Potterfield et al. |
| 7,730,824 | B1 | 6/2010 | Black |
| 7,774,972 | B2 | 8/2010 | Potterfield et al. |
| 7,779,572 | B2 * | 8/2010 | Potterfield et al. ..... 42/94 |
| 7,845,267 | B2 | 12/2010 | Potterfield et al. |
| 7,946,071 | B2 | 5/2011 | Cauley |
| 7,954,272 | B2 | 6/2011 | Potterfield et al. |
| 7,997,021 | B2 | 8/2011 | Cauley et al. |
| 8,011,129 | B2 | 9/2011 | Cauley |
| 2002/0113372 | A1 | 8/2002 | Love |
| 2002/0195752 | A1 | 12/2002 | Yang |
| 2003/0079395 | A1 | 5/2003 | Chong |
| 2003/0177685 | A1 | 9/2003 | Pinkley |
| 2003/0234205 | A1 | 12/2003 | McGuyer |
| 2004/0020097 | A1 | 2/2004 | Deros |
| 2004/0112777 | A1 | 6/2004 | Huang |
| 2004/0134113 | A1 | 7/2004 | Deros et al. |
| 2005/0000141 | A1 | 1/2005 | Cauley et al. |
| 2005/0011101 | A1 | 1/2005 | Gooder |
| 2005/0115137 | A1 | 6/2005 | Minneman |
| 2005/0178039 | A1 | 8/2005 | Flores |
| 2005/0183319 | A1 | 8/2005 | Franks |
| 2005/0188597 | A1 | 9/2005 | Keng et al. |
| 2005/0242250 | A1 | 11/2005 | Keng et al. |
| 2006/0063653 | A1 | 3/2006 | Wickens et al. |
| 2006/0070900 | A1 | 4/2006 | Brunson |
| 2006/0163534 | A1 | 7/2006 | Sugimoto et al. |
| 2006/0174532 | A1 | 8/2006 | Popikow |
| 2006/0175213 | A1 | 8/2006 | Hurt et al. |
| 2006/0218840 | A1 | 10/2006 | Cauley |
| 2006/0236584 | A1 | 10/2006 | Williams |
| 2006/0248774 | A1 | 11/2006 | Pierce et al. |
| 2006/0248775 | A1 | 11/2006 | Wade et al. |
| 2006/0254111 | A1 | 11/2006 | Giauque et al. |
| 2006/0277811 | A1 | 12/2006 | Peterson |
| 2006/0278797 | A1 | 12/2006 | Keng et al. |
| 2007/0029733 | A1 | 2/2007 | Anderson |
| 2007/0046760 | A1 | 3/2007 | Zara |
| 2007/0051028 | A1 | 3/2007 | Stordal |
| 2007/0068379 | A1 | 3/2007 | Sween et al. |
| 2007/0068835 | A1 | 3/2007 | Buie, II |
| 2007/0074439 | A2 | 4/2007 | Cauley et al. |
| 2007/0074440 | A2 | 4/2007 | Cauley |
| 2007/0094911 | A1 | 5/2007 | Rush et al. |
| 2007/0113460 | A1 | 5/2007 | Potterfield et al. |
| 2007/0175077 | A1 | 8/2007 | Laney et al. |
| 2007/0256346 | A1 | 11/2007 | Potterfield et al. |
| 2007/0262529 | A1 | 11/2007 | Gamez et al. |
| 2007/0266610 | A1 | 11/2007 | Coffield |
| 2007/0294929 | A1 | 12/2007 | Potterfield et al. |
| 2007/0294930 | A1 | 12/2007 | Mays |
| 2007/0295197 | A1 | 12/2007 | Potterfield |
| 2008/0023379 | A1 | 1/2008 | Potterfield et al. |
| 2008/0034636 | A1 | 2/2008 | Potterfield et al. |
| 2008/0041700 | A1 | 2/2008 | Potterfield et al. |
| 2008/0047189 | A1 | 2/2008 | Potterfield et al. |
| 2008/0054570 | A1 | 3/2008 | Potterfield et al. |
| 2008/0061509 | A1 | 3/2008 | Potterfield |
| 2008/0127815 | A1 | 6/2008 | Yale et al. |
| 2008/0128002 | A1 | 6/2008 | Jeffs |
| 2008/0156671 | A1 | 7/2008 | Jansson |
| 2008/0168697 | A1 | 7/2008 | Potterfield et al. |
| 2008/0174071 | A1 | 7/2008 | Potterfield et al. |
| 2008/0263928 | A1 | 10/2008 | Potterfield |
| 2008/0295379 | A1 | 12/2008 | Potterfield et al. |
| 2009/0000175 | A1 | 1/2009 | Potterfield et al. |
| 2009/0020447 | A1 | 1/2009 | Potterfield et al. |
| 2009/0049731 | A1 | 2/2009 | Seuk |
| 2009/0056192 | A1 | 3/2009 | Oz |
| 2009/0064559 | A1 | 3/2009 | Potterfield et al. |
| 2009/0126250 | A1 | 5/2009 | Keng |
| 2010/0032905 | A1 | 2/2010 | Morrow et al. |
| 2010/0102178 | A1 | 4/2010 | Smith et al. |
| 2010/0116163 | A1 | 5/2010 | Zara |
| 2010/0126055 | A1 | 5/2010 | Potterfield et al. |
| 2010/0138032 | A1 | 6/2010 | Potterfield |
| 2010/0236125 | A1 | 9/2010 | Morrow et al. |
| 2010/0270201 | A1 | 10/2010 | Cauley et al. |
| 2011/0024985 | A1 | 2/2011 | Potterfield |
| 2011/0036214 | A1 | 2/2011 | Potterfield |
| 2011/0036236 | A1 | 2/2011 | Potterfield et al. |
| 2011/0079524 | A1 | 4/2011 | Potterfield |
| 2011/0079542 | A1 | 4/2011 | Ellis et al. |
| 2011/0167705 | A1 | 7/2011 | Cauley et al. |
| 2011/0192069 | A1 | 8/2011 | Potterfield et al. |
| 2011/0225788 | A1 | 9/2011 | Potterfield |
| 2012/0011760 | A1 | 1/2012 | Cauley |
| 2012/0085012 | A1 | 4/2012 | Potterfield et al. |
| 2012/0144647 | A1 | 6/2012 | Cauley et al. |
| 2012/0174461 | A1 | 7/2012 | Potterfield et al. |
| 2012/0175844 | A1 | 7/2012 | Potterfield et al. |

OTHER PUBLICATIONS

U.S. Appl. No. 11/937,466, filed Nov. 8, 2007, Potterfield et al.

U.S. Appl. No. 12/172,848, filed Jul. 14, 2008, Cesternino et al.

"American Rifleman: What to do about recoil," LookSmart, http://www.findarticles.com/p/articles/mi_qa3623/is_199907/ai_n8861959/print, pp. 1-4 [Internet accessed on Jan. 4, 2006].

"Cabela's Rotary Media Separator," http://www.cabelas/en/templates/links/link.jsp;jsessionid=QYVQMKM0P0P5.., 2 pages [Internet accessed Apr. 24, 2007].

"Cleaning Cradles: Sinclaire Cleaning Cradles" p. 21, The date on which the Sinclair Folding Cleaning Cradle was first on sale is not known, but is believed to be circa 2004.

"Decker Rifle Vise," 1 page. The date on which the Decker Rifle Vise was first on sale is not known but is believed to be circa 2004.

"Eforcity Magnetic Screwdriver Set w/15 bits Great for Cellphones, Computers Includes: T6, Torx, Security Torx, Philips, Slotted, Spanner, Tri-Wing, Bent Pry Tool, Round Awl, Reset Pin for Game Boy Advance, Nintendo Wii, DS lite, NDS, Apple TV" , Amazon.com , accessed on Sep. 18, 2007.

"Gun Rest—Shooting Rest—Rifle Rests," http://www.jexploreproducts.com/gunrests-shootingrests.htm, 6 pages [Internet accessed Jul. 18, 2008].

"Plano Shooters Case, Brown Camo," The Sportsman's Guide, http://www.sportmansguide.com/cb/cb.asp?a=148225, the date on which the Plano Shooters Case was first on sale is not known but is believed to be circa 2004, 3 pages [Internet accessed No. Oct. 11, 2006].
"Reloading Manual Number Ten for Rifle and Pistol," The Cartridge Components, SPEER Omark Industries, pp. 28-54.
"Shotshell reloading with a GRABBER," MEC—Mayville Engineering Company, Inc., pp. 1-12.
"The Grabber and Hustler '76," MEC—Mayville Engineering Company, Inc., 2 pgs, date unknown.
"Uncle Bud's Bull Bags," http:www.unclebudscss.com/pages/Bulls%20bags.html, 2 pgs. [Internet accessed on Feb. 14, 2006].
"Uncle Bud'S Udder Bag," http:www.unclebudscss.com/pages/Udder%20Bags.html, 2 pgs. [Internet accessed on Feb. 14, 2006].
AcuSport, Outdoor Sporting Products, 3 pgs., undated.
Amazon.com, "CTK® P3 Ultimate Shooting Rest," Sports & Outdoors, http://www.amazon.com/CTK%C2%AE-P3-Ultimate-Shooting-Rest/dp/ . . . , 1 page [Internet accessed on Jul. 22, 2008].
Amazon.com, "SHTRS RDG Steady PNT Rifle Rest DLX, Grips/Pads/Stocks, Gun Accessories, Hunting & Shooting Accessories, Hunting Gear, Fishing & Hunting," http://www.amazon.com/STEADY-Accessories-Hunting-Shooting-Fishin . . . , 1 page [Internet accessed on Jul. 22, 2008].
Amazon.com, "Stoney Point Adjustable Shooting Rest w/Bag," Sports & Outdoors, http://www.amazon.com/Stoney-Point-Adjustable-Shooting-Rest/dp/B0.., 1 page [Internet accessed on Jul. 22, 2008].
Basspro.com, "Bass Pro Shops Outdoors Online: Offering the best in Fishing, Hunting and Outdoor Products," http://www.basspro.com/webapp/wcs/stores/servlet/Product_10151_- 1_10001 95064_SearchResults, 2 pages [Internet accessed on Aug. 6, 2008].
Battenfeld Technologies, Inc., "Steady Rest Portable Shooting Rest," 1 page [Internet accessed Jan. 25, 2006].
Big Boy Gun Toys, "Shooting Rest," http://www.bigboyguntoys.com/shootingrest.htm, 1 page [Internet accessed on Jul. 18, 2008].
Birchwood Casey 2005 Catalog, 28 pages.
Birchwood Casey 2006 Catalog. The date of availability of this catalog is unknown, but is believed to be in Jan. 2006 or later. pp. 5-17 (color copy attached).
Birchwood Casey, "Dirty Bird@Splattering Targets," http://www.birchwoodcasey.com/sport/target_index.asp?categoryID=4 &subcat=22 , pp. 1-4, internet accessed Jan. 16, 2006.
Birchwood Casey, "Shoot•N•C® Targets," http://www.birchwoodcasey.com/sport/target_index.asp?categoryID=4 &subcat=8, pp. 1-8, internet accessed Jan. 16, 2006.
Birchwood Casey, "Targets Spots®." http://www.birchwoodcasey.com/sport_index.asp?categoryID=4&subcat=12 , pp. 1-2, internet accessed Jan. 16, 2006.
Birchwood Casey, "World of Targets®" http://www.birchwoodcasey.com/sport/target_index.asp?categoryID=4 &subcat=13 , pp. 1-4, internet accessed Jan. 16, 2006.
Boyt Harness Company, Product Catalog, http://www.boytharness.com/catalog/index.php?cPath=22 2 pages [Internet accessed on Jul. 21, 2008].
Brass Cleaning Kits, http://www.berrysmfg.com/81.php, 1 page [Internet accessed Apr. 24, 2007].
Brownells Inc., Brownells Magna-Tip Screwdriver, Brownells Catalog No. 54 for 2001-2002, 2001, p. 151.
Brownells Inc., Brownells Magna-Tip Super-Sets, Brownells Catalog No. 54 for 2001-2002, 2001, p. 153.
Brownells Inc., Catalog No. 41 1988-1989 3 pages (8909).
Brownells Inc., Catalog No. 47 1994-1995 2 pages (8909).
Brownells Inc., Catalog No. 57. For 2004-2005. 2 pages.
Brownells Inc., Sight Base Cutters, Faxed Dec. 17, 2003, 1 page.
B-Square , Pro Gunsmith Screwdriver Set, B-Square Mounts Tools Accessories Product Catalog, p. 23, date unknown.
Cabela's "Master Catalog Fall 2003: Late-Season Edition" Cover page and p. 416. 2 pages.
Cabela's, "BenchBuddy® Gun Rest," http://www.cabelas.com/cabelas/en/templates/links/link.jsp?id=0005819221954a &type=product&cmCat=, © 1996-2008, 2 pages [Internet accessed on Aug. 6, 2008].
Cabela's, "Elite Rifle Rest," http://www.cabelas.com/cabelas/en/templates/links/link.jsp?id=0005817227855a&type=product &cmCat=, © 1996-2008, 2 pages [Internet accessed on Aug. 6, 2008].
Cabela's, "Hyskore® Dangerous Game™ Machine Rest," http://www.cabelas.com/cabelas/en/templates/links/link.jsp?id=0044091228566a&type=product&cmCat=, © 1996-2008, 2 pages [Internet accessed on Aug. 6, 2008].
Cabela's, "Hyskore® Ultimate Sighting Rest," http://www.cabelas.com/cabelas/en/templates/links/link.jsp?id=0024152226083a &type=product&cmCat=, © 1996-2008, 2 pages [Internet accessed on Aug. 6, 2008].
Cabela's, "Nitro Shoulder Shield Rest," http://www.cabelas.com/cabelas/en/templates/links/link.jsp?id=0040862228231a &type=product&cmCat=, © 1996-2008, 2 pages [Internet accessed on Aug. 6, 2008].
Cabela's, "Premier Rifle Rest," http://www.cabelas.com/cabelas/en/templates/links/link.jsp?id=0020904227856a&type=product &cmCat=.., © 1996-2008, 2 pages [Internet accessed on Aug. 6, 2008].
Cabela's, "Secure Bench Rest," http://www.cabelas.com/cabelas/en/templates/links/link.jsp;jsessionid=4F0LP0OW2HMRLLAQBBISCOF.., © 1996-2008, 2 pages [Internet accessed on Aug. 6, 2008].
Cabela's, "Sharp Shooter Auto Magnum Rifle Rest," http://www.cabelas.com/cabelas/en/templates/links/link.jsp?id=0054107229088a&type=product&cmCat=, © 1996-2008, 2 pages [Internet accessed on Aug. 6, 2008].
Cabela's, "Sharp Shooter Rifle Rest," http://www.cabelas.com/cabelas/en/templates/links/link.jsp?id=0005816222738a &type=product&cmCat=, © 1996-2008, 2 pages [Internet accessed on Aug. 6, 2008].
Cabela's, "Shooting Benches & Portable Rifle Shooting Bench Rest," http://www.cabelas.com/ssubcat-1/cat20793.shtml, 3 pages [Internet accessed Jul. 18, 2008].
Cabela's, "Sure Shot Shooting Vise/Rest," http://www.cabelas.com/cabelas/en/templates/product/standard-item.jsp?id= 00348272277 . . . , © 1996-2008, 2 pages [Internet accessed on Jul. 15, 2008].
Cabela's, "HySkore Sighting System and Cleaning Vise," the date on which the HySkore Sighting System and Cleaning Vise was first on sale is not known, but is believed to be circa Jan. 2005. However, a prototype of this product may have been shown to buyers at Cabela's circa Aug. 2004, 1 page.
Caldwell Insta-View™ 4" Targets.
Caldwell Shooting Supplies, 2006 Catalog, pp. 18, 5, 12, 14 and 15.
Caldwell Shooting Supplies, Targets & Target Accessories, Instra-View™ Targets, 1 page.
Caldwells Insta-View 4" Targets, 1 page [product photo].
Californiavarmintcallers.com—Forum, http://californiavarmintcallers.com/community/modules/newbb/viewtopic.php?topic_id=10 &forum=9&PHPSESSID=074ed8c7 . . . , pp. 1-4, accessed Jan. 16, 2006.
Canadian Camo, "Gun Rest," http://media5.magma.ca/www.canadiancamo.com/catalog/product_info.php?products_id= . . . , 2 pages [Internet accessed on Feb. 13, 2006].
Carmichael, J., "Reloading for Accuracy," Lyman Reloading Handbook, 46th Edition, pp. 68-77.
Champion Targets, "Next Generation Paper Targets," http://www.championtarget.com/products/targets/next_generation_targets.aspx , pp. 1-3, [internet accessed Jan. 16, 2006].
Champion Traps & Target, 2005 Product Catalog , 12 pages.
Chastain, R., "Load 'em Up!" About.com: Hunting/ Shooting, http://hunting.about.com/od/reloadinginfo/a/aaloademup_2htm , 6 pages [Internet accessed on Aug. 31, 2007].
Cork Industries, Inc., "Double Bumping Coating Applications," Cork Tech TalkNews, Feb. 1997, 2 pages.
CTK Precision, "P3 Ultimate Shooting Rest," http://www.ctkprecision.com/index.asp?PageAction=VIEWPROD&ProdOID=2, 3 pages [Internet accessed on Jul. 18, 2008].
CTK Precision, All Products, http://www.ctkprecision.com/index.asp?PageAction=VIEWCATS&Cate.., 3 pages [Internet accessed on Jul. 22, 2008].
CV-500, 3 pages [product photos].

Device manufactured by Shooter's Ridge, a division of ATK, and available at least by late 2005, 1 page.
Dillon Precision CV-500 Cartridge Case Vibratory Cleaner, 6 pages [product photos].
E. Arthur Brown Company, "A Shooting Rest that Really Works..," http://www.eabco.com/TargetShooting01.html, © 2007-2008, 1 page [Internet accessed Jul. 18, 2008].
Edgewood Shooting Bags Catalog, http://www.edgebag.com/catalog.php, 7 pages [Internet accessed on Feb. 14, 2006].
Ellett Brothers, Rests & Gun Vises, pp. 621-622, date unknown.
Final Office Action; U.S. Appl. No. 10/865,595; Mailed on Apr. 3, 2007, 10 pages.
Final Office Action; U.S. Appl. No. 11/206,430; Mailed on Oct. 29, 2007, 13 pages.
Final Office Action; U.S. Appl. No. 11/206,430; Mailed on Nov. 24, 2008, 12 pages.
Final Office Action; U.S. Appl. No. 11/206,430; Mailed on Apr. 1, 2010, 14 pages.
Final Office Action; U.S. Appl. No. 11/271,100; Mailed on Sep. 22, 2008, 8 pages.
Final Office Action; U.S. Appl. No. 11/339,863; Mailed on Mar. 10, 2009, 6 pages.
Final Office Action; U.S. Appl. No. 11/431,956; Mailed on Nov. 27, 2009, 13 pages.
Final Office Action; U.S. Appl. No. 11/505,784; Mailed on Dec. 19, 2008, 10 pages.
Final Office Action; U.S. Appl. No. 11/507,683; Mailed on Apr. 6, 2010, 7 pages.
Final Office Action; U.S. Appl. No. 11/607,550; Mailed on Nov. 27, 2009, 14 pages.
Final Office Action; U.S. Appl. No. 11/679,100; Mailed on Aug. 3, 2009, 9 pages.
Final Office Action; U.S. Appl. No. 11/679,136; Mailed on Apr. 10, 2009, 22 pages.
Final Office Action; U.S. Appl. No. 11/679,832; Mailed on Jun. 8, 2010, 12 pages.
Final Office Action; U.S. Appl. No. 11/801,341; Mailed on Sep. 30, 2009, 6 pages.
Final Office Action; U.S. Appl. No. 11/844,980; Mailed on May 25, 2010, 6 pages.
Final Office Action; U.S. Appl. No. 11/853,763; Mailed on Jul. 13, 2009, 7 pages.
Final Office Action; U.S. Appl. No. 12/476,041; Mailed on Jul. 20, 2010, 7 pages.
Final Office Action; U.S. Appl. No. 12/177,032; Mailed on Oct. 5, 2010, 11 pages.
Grafix Plastics, http://grafixplastic.com/plastic_film_g.asp?gclid=CK-5-_7gnY4CFRVNhgodjFhfSQ , 29 pages [Internet accessed on Aug. 30, 2007].
Harris, J. et al., "The Art and Science of Annealing," http://www.6mmbr.com/annealing.html, © 2005, 13 pages [Internet accessed on Aug. 13, 2007].
Hyskore, "Rest—Dangerous Game Machine Rest," Hyskore Rest, Professional firearm rests, http://www.hyskore.com/rests.htm, 2 pages [Internet accessed Jul. 21, 2008].
Hyskore: Professional Shooting Accessories. "Dangerous Game Machine Rest," Accessed Feb. 22, 2006 www.hyskore.com, 10 pages.
Hyskore: Professional Shooting Accessories. "Hydraulic Trigger Release." Accessed Feb. 22, 2006. www.hyskore.com 7 pages.
International Search Report and Written Opinion; International Patent Application No. PCT/US07/76440; Filed: Aug. 21, 2007; Applicant: Battenfeld Technologies, Inc.; Mailed on Sep. 30, 2008.
International Search Report and Written Opinion; International Patent Application No. PCT/US07/76587; Filed: Aug. 22, 2007; Applicant: Battenfeld Technologies, Inc.; Mailed on Jul. 30, 2008.
International Search Report and Written Opinion; International Patent Application No. PCT/US07/83674; Filed: Nov. 5, 2007; Applicant: Battenfeld Technologies, Inc.; Mailed on Jun. 11, 2008.
Joe's, "Shooter's Ridge Steady Point Shooting Rest," http://www.joessport.com/product/index.jsp?productID=3155005&cp=726872&parentpag.., Item No. 3155005, 1 page [Internet accessed Jul. 17, 2008].
Lahti Company Brochure, "Rock Solid Hold," Rifle Evaluator, http://www.lathicompany.com/Forms/EvaluatorBrochure2.jpg, 2 pages. [Internet accessed Jan. 16, 2006].
Lahti Company Brochure, "Rifle Evaluator: No Pain, No Fear, No Flinching, No Body Movement," www.lahticompany.com, 2 pages, undated.
Lee Precision, Inc., "Load-All," 1 page.
Lee Precision, Inc., "The World's Fastest Handloading Press . . . Lee Progressive 1000," 1985 Catalog, pp. 1-15.
Lohman Sight Vise, 4 pages product photographs, the date on which the Lohman Site Vise was first on sale is not known, but is believed to be circa 2004.
Lyman Hornady Case Tumbler, 2 pages [product photos].
Lyman Turbo 600 Tumbler, 3 pages [product photos].
Lyman Turbo Pro 1200 Tumber, 2 pages [product photos].
Lyman, "A History of Lyman Metallic Reloading," Reloading Handbook, 46th Edition, pp. 10-31.
Lyman, "Introduction to Reloading," Reloading Handbook, 46th Edition, pp. 170-203.
MacksPW.com, "Desert Mountain Bench Master Rifle Rest," http://www.macksqw.com/Item—i-DESBM1, © 2004-2008, 1 page [Internet accessed Jul. 22, 2008].
Midway USA, Chapman 27-Piece Deluxe Screwdriver Set, Master Catalog and Reference Guide #2, 2004, p. 440.
Midway USA, Pachmayr Professional Screwdriver Set, Master Catalog and Reference Guide #2, 2004, p. 448.
Midway USA, Wheeler Engineering Space-Saver Gunsmithing Screwdriver Set, Master Catlog and Reference Guide #2, 2004, p. 453.
Midway USA. "Tipton Range Box with Ultimate Rifle, Handgun Cleaning Kit (No Solvents)," http://www.midwayusa.com/rewriteaproduct/135086, The date on which the Tipton Range Box was first on sale is not known, but is believed to be circa 2004, 2 pages.
MidwayUSA, "ADG Rifle Shooting Rest," http://www.midwayusa.com/eproductpage.exe/showproduct?saleitemid=992071&t=11082005, 2005, 3 pages [Internet accessed on Aug. 6, 2008].
MidwayUSA, "Caldwell Full Length Fire Control Shooting Rest," http://www.midwayusa.com/eproductpage.exe/showproduct?saleitemid=683866&t=11082005, 2005, 3 pages [Internet accessed on Aug. 6, 2008].
MidwayUSA, "Caldwell Lead Sled DFT Rifle Shooting Rest," http://www.midwayusa.com/eproductpage.exe/showproduct?saleitemid=149023&t=11082005, 2005, 6 pages [Internet accessed on Aug. 6, 2008].
MidwayUSA, "Caldwell Lead Sled Rifle Shooting Rest," http://www.midwayusa.com/eproductpage.exe/showproduct?saleitemid=152664&t=11082005, 2005, 8 pages [Internet accessed on Aug. 6, 2008].
MidwayUSA, "Caldwell Steady Rest NXT Rifle Shooting Rest," http://www.midwayusa.com/eproductpage.exe/showproduct?saleitemid=838651&t=11082005, 2005, 4 pages [Internet accessed on Aug. 6, 2008].
MidwayUSA, "Caldwell Zero-Max Rifle Shooting Rest," http://www.midwayusa.com/eproductpage.exe/showproduct?saleitemid=726222&t=11082005, 2005, 3 pages [Internet accessed on Aug. 6, 2008].
MidwayUSA, "CTK Precision P3 Ultimate Shooting Rest," http://www.midwayusa.com/eproductpage.exe/showproduct?saleitemid=114699&t=11082005, 2005, 2 pages [Internet accessed on Aug. 6, 2008].
MidwayUSA, "Hyskore® dangerous Game Rifle Shooting Rest," http://www.midwayusa.com/eproductpage.exe/showproduct?saleitemid=729197&t=11082005, 2005, 3 pages [Internet accessed on Aug. 6, 2008].
MidwayUSA, "Hyskore® Precision Gas Dampened Recoil Reducing Rifle Shooting Rest," http://www.midwayusa.com/eproductpage.exe/showproduct?saleitemid=838848&t=11082005, 2005, 4 pages [Internet accessed on Aug. 6, 2008].
MidwayUSA, "Hyskore® Swivel Varmint Rifle Shooting Rest," http://www.midwayusa.com/eproductpage.exe/showproduct?saleitemid=587606&t=11082005, 2005, 3 pages [Internet accessed on Aug. 6, 2008].

MidwayUSA, "Shooters Ridge Steady Point Rifle Shooting Rest and Vise," http://www.midwayusa.com/eproductpage.exe/showproduct?saleitemid=341095&t=11082005, 2005, 4 pages [Internet accessed on Aug. 6, 2008].
MidwayUSA, "Shooters Ridge Steady Point Rifle Shooting Rest," http://www.midwayusa.com/eproductpage.exe/showproduct?saleitemid=826745&t=11082005, 2005, 5 pages [Internet accessed on Aug. 6, 2008].
MidwayUSA, "Shooting Supplies—Shop Everything for Your Firearm at MidwayUSA," http://www.midwayusa.com/browse/BrowseProducts.aspx?categoryStrin . . . , 15 pages [Internet accessed on Jul. 21, 2008].
MidwayUSA, "Stoney Point Bench Anchor Rifle Shooting Rest," http://www.midwayusa.com/eproductpage.exe/showproduct?saleitemid=347174&t=11082005, 2005, 2 pages [Internet accessed on Aug. 6, 2008].
Milek, B., "Handloading for Hunting" New Products from RCBS, Lee, Accurate Arms, Peterson's Hunting, Mar. 1985, p. 21.
Millett, "BenchMaster Shooting Rests," 1 page, Undated.
MTM Case-Gard, "Gun Maintenance Centers," http://www.mtmcase-gard.com/products/shooting/gunm.html, the date on which the MTM Gun Maintenance Center was first on sale is not known, but is believed to be circa 2004, 2 pages [Internet accessed Oct. 11, 2006].
MTM Case-Gard, "MTM Shoulder-Gard Rifle Rest," Cover Photo for Rest, p. 2, date unknown.
MTM Case-Gard, "Rifle rest and pistol shoot rest," http://www/mtmcase-gard.com/products/shooting/shoo.html, the date on which the MTM Site-In-Clean was first on sale is not known, but is believed to be circa 2004, 3 pages [Internet accessed on Oct. 11, 2006].
Non-Final Office Action; U.S. Appl. No. 10/865,595; Mailed on Jun. 7, 2006, 8 pages.
Non-Final Office Action; U.S. Appl. No. 11/206,430; Mailed on Jun. 23, 2009, 13 pages.
Non-Final Office Action; U.S. Appl. No. 11/206,430; Mailed on May 14, 2008, 10 pages.
Non-Final Office Action; U.S. Appl. No. 11/206,430; Mailed on May 21, 2007, 12 pages.
Non-Final Office Action; U.S. Appl. No. 11/271,100; Mailed on Mar. 26, 2008, 9 pages.
Non-Final Office Action; U.S. Appl. No. 11/311,530; Mailed on Feb. 13, 2007, 10 pages.
Non-Final Office Action; U.S. Appl. No. 11/339,863; Mailed on Sep. 23, 2008, 7 pages.
Non-Final Office Action; U.S. Appl. No. 11/418,407; Mailed on Feb. 24, 2009, 9 pages.
Non-Final Office Action; U.S. Appl. No. 11/431,956; Mailed on Mar. 2, 2009, 16 pages.
Non-Final Office Action; U.S. Appl. No. 11/505,784; Mailed on Dec. 26, 2007, 14 pages.
Non-Final Office Action; U.S. Appl. No. 11/505,784; Mailed on Oct. 27, 2009, 8 pages.
Non-Final Office Action; U.S. Appl. No. 11/507,683; Mailed on Sep. 18, 2008, 8 pages.
Non-Final Office Action; U.S. Appl. No. 11/607,550; Mailed on Mar. 2, 2009, 11 pages.
Non-Final Office Action; U.S. Appl. No. 11/607,550; Mailed on Jun. 17, 2010, 12 pages.
Non-Final Office Action; U.S. Appl. No. 11/679,100; Mailed on Oct. 16, 2008, 11 pages.
Non-Final Office Action; U.S. Appl. No. 11/679,100; Mailed on May 28, 2010, 9 pages.
Non-Final Office Action; U.S. Appl. No. 11/679,136; Mailed on Aug. 18, 2008, 6 pages.
Non-Final Office Action; U.S. Appl. No. 11/679,136; Mailed on Aug. 28, 2008, 8 pages.
Non-Final Office Action; U.S. Appl. No. 11/679,169; Mailed on Apr. 28, 2009, 11 pages.
Non-Final Office Action; U.S. Appl. No. 11/679,832; Mailed on Aug. 28, 2009, 9 pages.
Non-Final Office Action; U.S. Appl. No. 11/739,077; Mailed on Oct. 8, 2009, 7 pages.
Non-Final Office Action; U.S. Appl. No. 11/740,908; Mailed on Jan. 29, 2010, 8 pages.
Non-Final Office Action; U.S. Appl. No. 11/746,551; Mailed on Apr. 14, 2010, 8 pages.
Non-Final Office Action; U.S. Appl. No. 11/801,341; Mailed on Jan. 13, 2009, 7 pages.
Non-Final Office Action; U.S. Appl. No. 11/844,980; Mailed on Aug. 21, 2008, 8 pages.
Non-Final Office Action; U.S. Appl. No. 11/846,408; Mailed on Aug. 18, 2008, 8 pages.
Non-Final Office Action; U.S. Appl. No. 11/853,745; Mailed on Jun. 19, 2009, 11 pages.
Non-Final Office Action; U.S. Appl. No. 11/853,763; Mailed on Dec. 22, 2008, 6 pages.
Non-Final Office Action; U.S. Appl. No. 12/117,668; Mailed on Aug. 13, 2009, 15 pages.
Non-Final Office Action; U.S. Appl. No. 12/177,032; Mailed on Feb. 23, 2010, 6 pages.
Non-Final Office Action; U.S. Appl. No. 12/209,113; Mailed on Sep. 23, 2009, 6 pages.
Non-Final Office Action; U.S. Appl. No. 12/276,229; Mailed on Aug. 30, 2010, 8 pages.
Non-Final Office Action; U.S. Appl. No. 12/476,041; Mailed on Nov. 18, 2009, 6 pages.
Non-Final Office Action; U.S. Appl. No. 12/037,336; Mailed on Sep. 15, 2010, 33 pages.
Precision Shooting, Inc., Bald Eagle Front Rest, The Accurate Rifle, vol. 6, Issue No. 4, May 2003, p. 47.
Protektor Model, "The Original Leather Rifle and Pistol Rest," http://www.protektormodel.com/, 12 pages [Internet accessed on Feb. 14, 2006].
RCBS Automatic Primer Tool, pp. 68-71, undated.
RCBS, "Reloading Equipment," http://www.rcbs.com/default.asp?menu=1&s1=4&s2=3&s3=25, 1 page [Internet accessed Apr. 24, 2007].
Shooters Ridge, "Deluxe Rifle Rest," http://www.shootersridge.com, 1 page [Internet accessed Jul. 21, 2008].
Shooters Ridge, "Shooting Rest with Gun Vise," http://www.shootersridge.com, 1 page [Internet accessed Jul. 17, 2008].
Sinclair International, Sinclair Shooting Rests, Products for the Precision Shooter, 2002, Issue No. 2002-B pp. 76-78.
Sweeney, P., "Gunsmithing: Measure Headspace," Peterson's Rifleshooter, http://www.rifleshootermag.com/gunsmithing/headspace_0612/ , 4 pages [Internet accessed Dec. 11, 2004].
Tenex Precision Co., "Recoil A-Rest-R," 4 pages, date unknown [product photos].
The Blue Press, "Dillon Case Preparation Equipment," http://dillonprecision.com/template/p.cfm?maj=16&min=0&dyn=1&, Apr. 2007, 2 pages [Internet accessed Apr. 24, 2007].
Non-Final Office Action; U.S. Appl. No. 11/746,551; Mailed on Jul. 8, 2011, 14 pages.
Non-Final Office Action; U.S. Appl. No. 12/769,438; Mailed on Jul. 15, 2011, 55 pages.
Non-Final Office Action; U.S. Appl. No. 12/276,223; Mailed on Jul. 19, 2011, 11 pages.
Non-Final Office Action; U.S. Appl. No. 12/177,032; Mailed on Aug. 15, 2011, 9 pages.
Non-Final Office Action; U.S. Appl. No. 12/172,848, Mailed on Nov. 22, 2010, 32 pages.
Non-Final Office Action; U.S. Appl. No. 11/206,430; Mailed on Oct. 14, 2010, 18 pages.
Non-Final Office Action; U.S. Appl. No. 11/844,980; Mailed on Dec. 16, 2010, 9 pages.
Non-Final Office Action; U.S. Appl. No. 12/276,223; Mailed on Dec. 27, 2010, 37 pages.
Non-Final Office Action; U.S. Appl. No. 11/431,956; Mailed on Feb. 9, 2011, 13 pages.
Final Office Action; U.S. Appl. No. 11/679,100: Mailed on Feb. 18, 2011, 11 pages.
Final Office Action; U.S. Appl. No. 11/206,430; Mailed on May 12, 2011, 14 pages.
U.S. Appl. No. 11/505,784, filed Aug. 16, 2006, Cauley.
U.S. Appl. No. 11/862,821, filed Sep. 27, 2007, Cesternino.

Ishop2.com "Hoppe's Gunsmith's Fully Adjustable Bench Vise" 3 pages. The date on which the Hoppe's Gunsmith's Fully Adjustable Bench Vise was first on sale is not known, but is believed to be circa 2004.
Auto-Flo Lyman Turbo 1200 Tumbler, 2 pages [product photos].
Battenfeld Technologies, Inc., "Gun Vise," Tipton Gun Cleaning Supplies, Battenfeld Technologies, Inc. 2004 Catalog, p. 32, Product No. 782-731, 2 pgs.
European Search Report; European Patent Application No. 07863915.0; Filed: Nov. 5, 2007; Applicant: Battenfeld Technologies, Inc.; Mailed on Oct. 14, 2010.
Final Office Action; U.S. Appl. No. 11/679,100; Mailed on Feb. 18, 2011, 11 pages.
Final Office Action; U.S. Appl. No. 12/848,649; Mailed on Jan. 18, 2012, 6 pages.
Non-Final Office Action; U.S. Appl. No. 11/607,550; Mailed on 11/23/11, 8 pages.
Non-Final Office Action; U.S. Appl. No. 12/614,578; Mailed on Dec. 8, 2011, 12 pages.
Non-Final Office Action; U.S. Appl. No. 12/899,418; Mailed on Jan. 3, 2012, 30 pages.
Non-Final Office Action; U.S. Appl. No. 11/431,956; Mailed on May 7, 2012, 10 pages.
Non-Final Office Action; U.S. Appl. No. 13/095,549; Mailed on Feb. 7, 2012, 13 pgs.
Non-Final Office Action; U.S. Appl. No. 13/183,212; Mailed on Apr. 2, 2012, 8 pages.
Non-Final Office Action; U.S. Appl. No. 13/344,280; Mailed on Feb. 27, 2012, 9 pages.

* cited by examiner

ATTACHMENT MECHANISMS FOR COUPLING FIREARMS TO SUPPORTING STRUCTURES

CROSS-REFERENCE TO RELATED APPLICATION

The present application is a divisional of U.S. patent application Ser. No. 12/209,113,filed Sep. 11, 2008, now U.S. Pat. No. 7,845,267, which claims priority to U.S. Provisional Application Ser. No. 60/971,507, filed Sep. 11, 2007, the disclosures of which are incorporated herein by reference in their entirety.

TECHNICAL FIELD

The present disclosure is generally related to attachment mechanisms for attaching firearms to support structures, e.g., bipods.

BACKGROUND

In recent centuries, firearms have been widely used for hunting games or waging wars. To achieve precision in using firearms, monopods, bipods, tripods, gun carriages, and/or other support structures are typically attached to firearms for providing stability during firing. However, the support structures can reduce the portability of the firearms by increasing the weight and the size of the complete assemblies. Accordingly, attachment mechanisms that can enable quick attachment/detachment of the support structures to from the firearms are needed for improved operability.

DETAILED DESCRIPTION

Specific details of several embodiments of the disclosure are described below with reference to embodiments of an attachment mechanism for attaching a support structure (e.g., a bipod) to a firearm. The term "firearm" generally refers to a device that can discharge a projectile with a propellant (e.g., a combustion gas, compressed air, etc.) Examples of a firearm include rifles, machine guns, muskets, air rifles/pistols, etc. Several other embodiments may have different configurations, components, or procedures than those described in this section. A person of ordinary skill in the art, therefore, will accordingly understand that the disclosure may have other embodiments with additional elements, or the invention may have other embodiments without several of the elements shown and described below.

Figure 1:
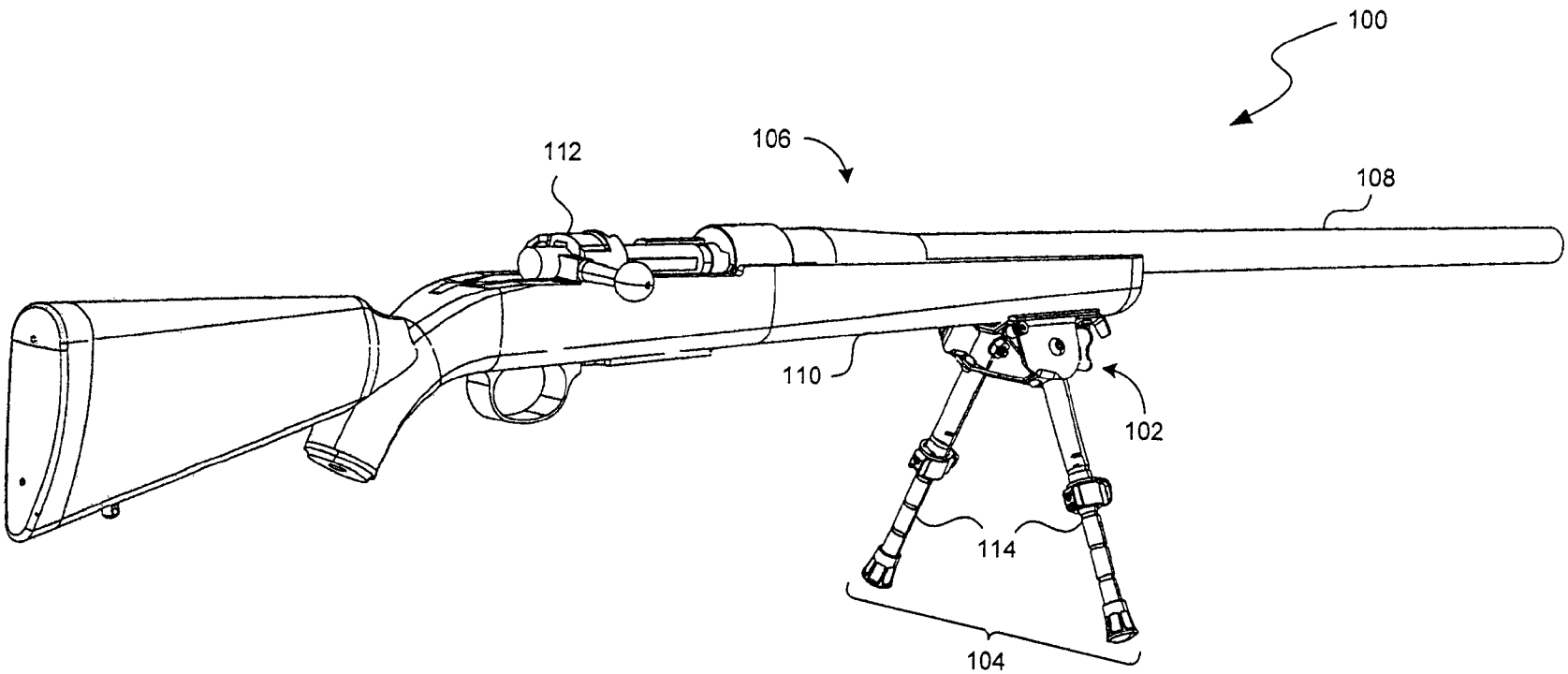
FIG. 1 is an isometric view of a firearm assembly in accordance with an embodiment of the disclosure.

FIG. 1 is an isometric view of a firearm assembly 100 in accordance with an embodiment of the disclosure. As illustrated in FIG. 1, the firearm assembly 100 can include a firearm 106, a support structure 104, and an attachment mechanism 102 connecting the support structure 104 to the firearm 106. The firearm 106 can include a barrel 108 operatively coupled to a firing mechanism 112 (e.g., a bolt-action firing mechanism), and a stock 110 at least partially supporting and/or housing the barrel 108 and the firing mechanism 112. The firearm 106 is generally illustrated in FIG. 1 as a rifle; however, in other embodiments, the firearm 106 can also be a handgun, a machine gun, and/or other types of firearm.

In the illustrated embodiment, the support structure 104 includes a bipod 114 extending from the stock 110 of the firearm 106. In certain embodiments, the bipod 114 can include two cylindrical tubes constructed from a metal, a metal alloy, a polymeric material, and/or other suitable material with sufficient strength. In other embodiments, the bipod 114 can also include springs, sleeves, pivots, and/or other features for collapsing the bipod 114 for storage and/or transport. In further embodiments, the support structure 104 can also include a monopod, a tripod, a gun carriage, and/or other support devices that can provide support to the firearm during use.

The attachment mechanism 102 can be positioned between the firearm 106 and the support structure 104. In one aspect of this embodiment, the attachment mechanism 102 can be configured to releasably attach/detach the support structure 104 to/from the firearm 106. In another aspect of this embodiment, the attachment mechanism 102 can be configured to enable a quick release of the support structure 104 from the firearm 106 for improving operability of the firearm assembly 100, as described in more detail below with reference to FIGS. 2-4B.

Even though the firearm assembly 100 is illustrated in FIG. 1 to have particular components, in certain embodiments, the firearm assembly 100 can also include shoulder straps, telescopes, external magazines, and/or other accessories for the firearm 106. In other embodiments, portions of the stock 110 and/or other components of the firearm assembly 100 can be different and/or omitted.

Figure 2:
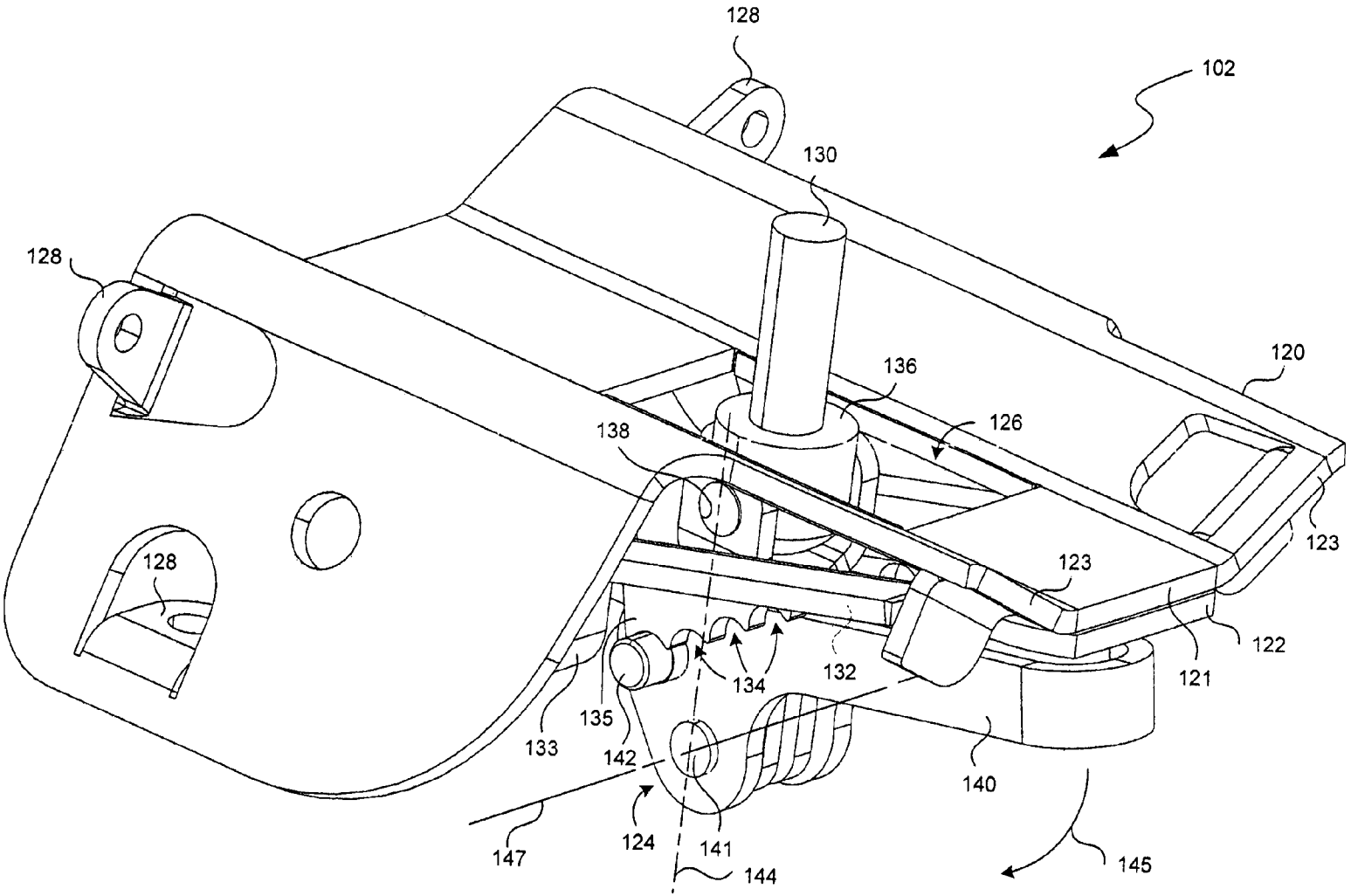
FIG. 2 is an isometric view of an embodiment of an attachment mechanism suitable for use in the firearm assembly of FIG. 1 in accordance with an embodiment of the disclosure.

FIG. 2 is an isometric view of an embodiment of the attachment mechanism 102 in FIG. 1 in accordance with an embodiment of the disclosure. As shown in FIG. 2, the attachment mechanism 102 can include an interface member 120, a mounting member 122 attached to the interface member 120, and a latching subassembly 124 movably coupled to the mounting member 122. In the illustrated embodiment, the interface member 120 and the mounting member 122 are shown as stand-alone components couplable with fasteners (e.g., bolts and nuts). However, in certain embodiments, the interface member 120 and the mounting member 122 can be formed integrally as a single component.

The interface member 120 can include a center portion 121 and two side portions 123 extending from the center portion 121. The center portion 121 and the side portions 123 can be arranged at an angle to receive and accommodate the stock 110 (FIG. 1). The center portion 121 can include an aperture 126 through which a connector 130 can extend to engage the stock 110. In one embodiment, the connector 130 can include a swivel stud. In other embodiments, the connector 130 can also include a threaded stud and/or other fasteners. The side portions 123 can also include connecting features, e.g., taps 128, for connecting to other components of the attachment mechanism 102, the support structure 104 (FIG. 1), and/or other components of the firearm assembly 100 (FIG. 1).

The mounting member 122 can include a mounting plate 132 configured to engage the center portion 121 of the interface member 120, an anchor plate 133 configured to engage the side portions 123 of the interface member 120, and a receiving plate 135 extending from the mounting plate 132. The receiving plate 135 can include notches 134 and/or other engagement features for receiving the latching subassembly 124. Embodiments of the mounting member 122 are discussed in more detail below with reference to FIG. 3.

The latching subassembly 124 can include an attachment portion 136, a latching arm 140 movably coupled to the attachment portion 136 by a coupling pin 141, and a latching pin 142 extending outwardly from the latching arm 140 and resting in one of the notches 134 of the mounting member 122. In the illustrated embodiment, the attachment portion 136 is fixedly coupled to the connector 130 with a swivel pin 138. In other embodiments, the attachment portion 136 can be coupled to the connector 130 with a screw, a bolt, a nut, and/or other fasteners. Embodiments of the latching subassembly 124 are discussed in more detailed below with reference to FIGS. 4A-B.

Referring to FIG. 1 and FIG. 2 together, the attachment mechanism 102 can securely hold the firearm 106 and the support structure 104 together during use.

When assembled, the connector 130 is fixedly attached to the stock 110 of the firearm 106, and the attachment portion 136 is fixedly coupled to the connector 130. As a result, the latching subassembly 124 can force the stock 110 toward the attachment mechanism 102 via the connector 130 until the stock 110 securely rests on the interface member 120. Because different firearms may have different stock configurations (e.g., height, shape, etc.), a user can select one of the notches 134 that provides the required height between the latching pin 142 and the center portion 121 of the interface member 120 to securely engage the firearm 106.

During detachment, a user can pull the latching arm 140 clockwise (as indicated by an arrow 145) away from the mounting member 122. As the latching arm 140 pivots around the coupling pin 141, the latching pin 142 rotates toward an axis 144 that passes through the centers of the swivel pin 138 and the coupling pin 141. As a result, the rotation of the latching arm 140 pulls the stock 110 toward the interface member 120 because the distance between the swivel pin 138 and the coupling pin 141 increases. As all three pins (i.e., the swivel pin 138, the coupling pin 141, and the latching pin 142) are aligned along the axis 144, the attachment mechanism 102 exerts the maximum pulling force on the stock 110. As the user continues to pull the latching arm 140 clockwise, the latching pin 142 passes and moves away from the axis 144. As a result, the amount of pulling force exerted on the stock 110 is reduced because the distance between the swivel pin 138 and the coupling pin 141 decreases. As the user continues to pull the latching arm 140 clockwise, the pressure between the stock 110 and the interface member 120 can be reduced or even eliminated. After the pressure is at least reduced, the user can detach the attachment mechanism 102 from the stock 110 by removing the swivel pin 138.

Figure 3:
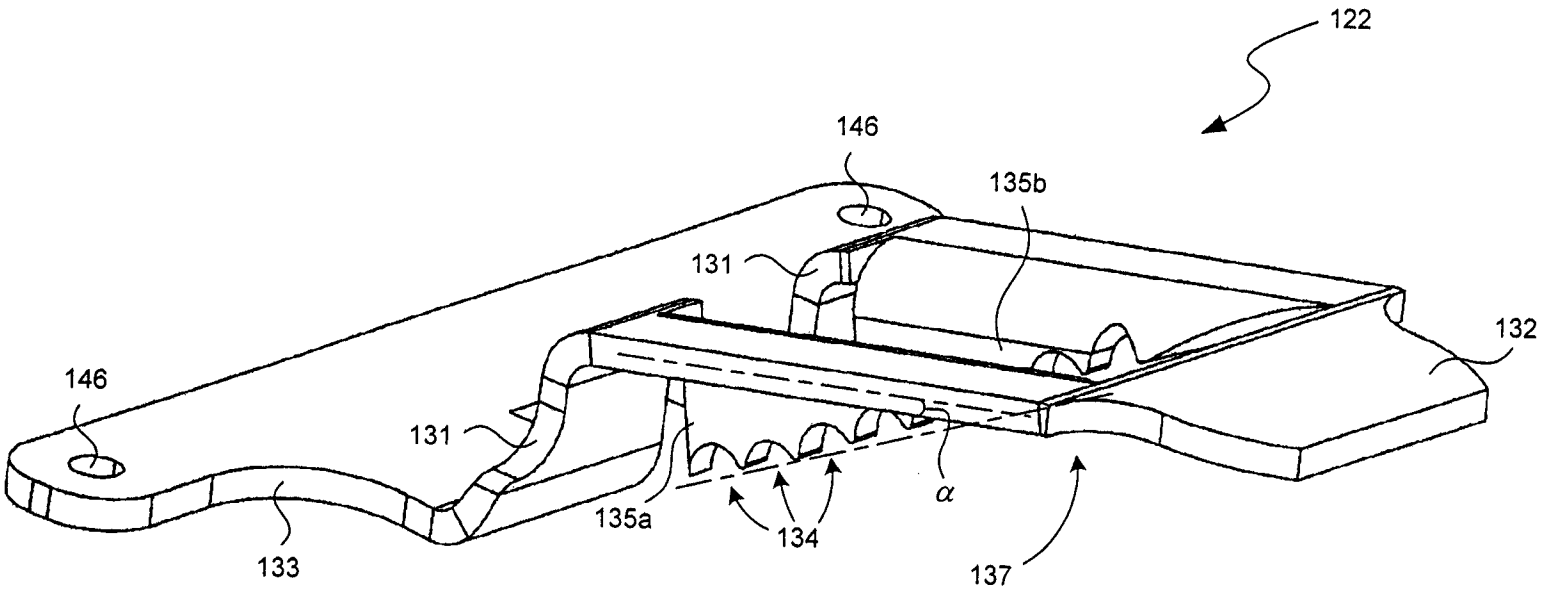
FIG. 3 is an isometric view of an embodiment of a mounting member in FIG. 2 in accordance with an embodiment of the disclosure.

FIG. 3 is an isometric view of an embodiment of the mounting member 122 in FIG. 2 in accordance with an embodiment of the disclosure. As illustrated in FIG. 3, the mounting member 122 includes the mounting plate 132, the anchor plate 133, and an intermediate portion 131 connecting the mounting plate 132 and the anchor plate 133. In the illustrated embodiment, the mounting plate 132 and the anchor plate 133 are offset from one another; however, in other embodiments, these components can be generally planar. The anchor plate 133 can include connecting features 146 (e.g., holes) for coupling to the interface member 120 (FIG. 2) and/or other components of the attachment mechanism 102.

The mounting plate 132 can also include an opening 137 configured to at least partially align with the aperture 126 (FIG. 2) of the interface member 120. The mounting member 122 also includes a first receiving plate 135*a* and a second receiving plate 135*b* having the notches 134 and extending from the mounting plate 132 along two sides of the opening 137. As shown in FIG. 3, the tops of the notches 134 form generally a line at an angle $\alpha$ with the mounting plate 132. The angle $\alpha$ can be from about 5° to about 85°, preferably from about 15° to about 60°, and more preferably from about 25° to about 45°.

Figure 4A:
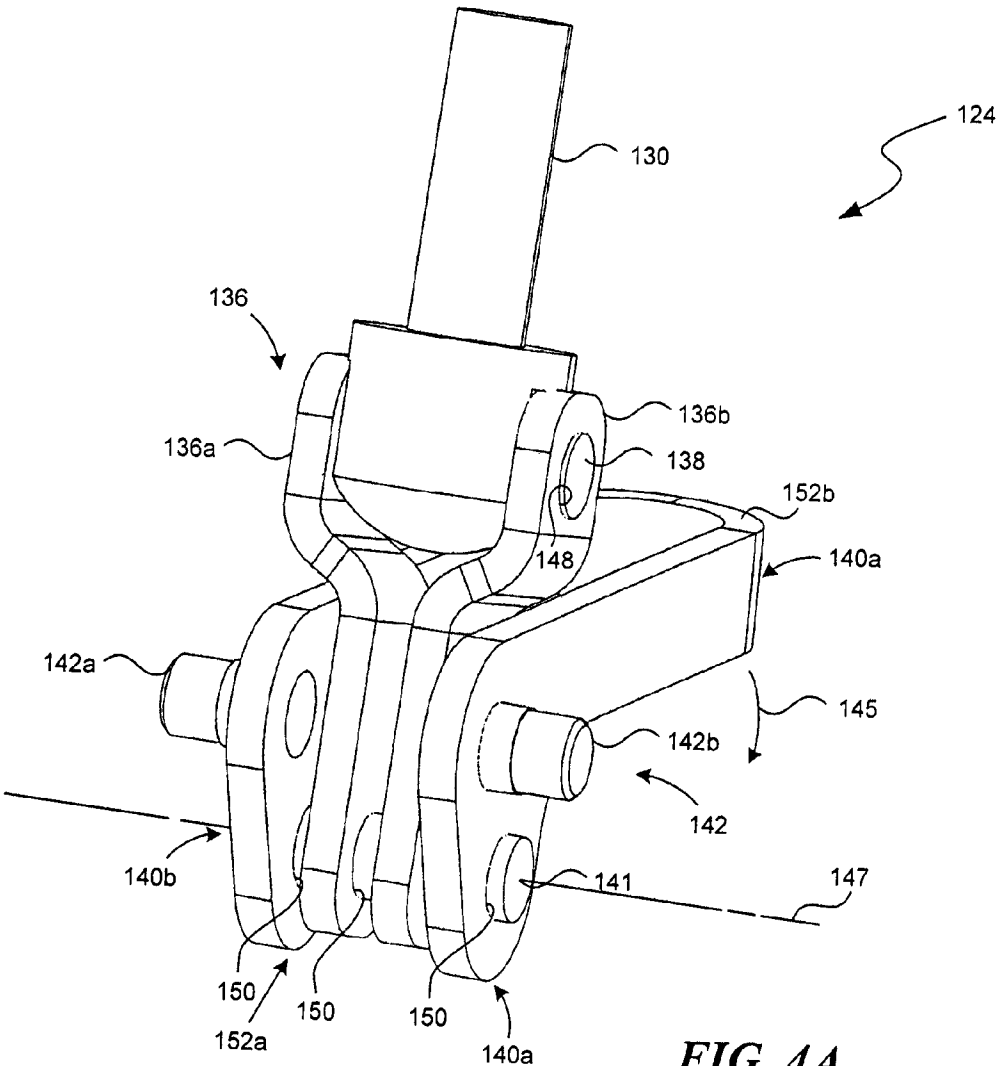
FIGS. 4A-B are isometric views of an embodiment of a latching subassembly in FIG. 2 in accordance with an embodiment of the disclosure.
Figure 4B:
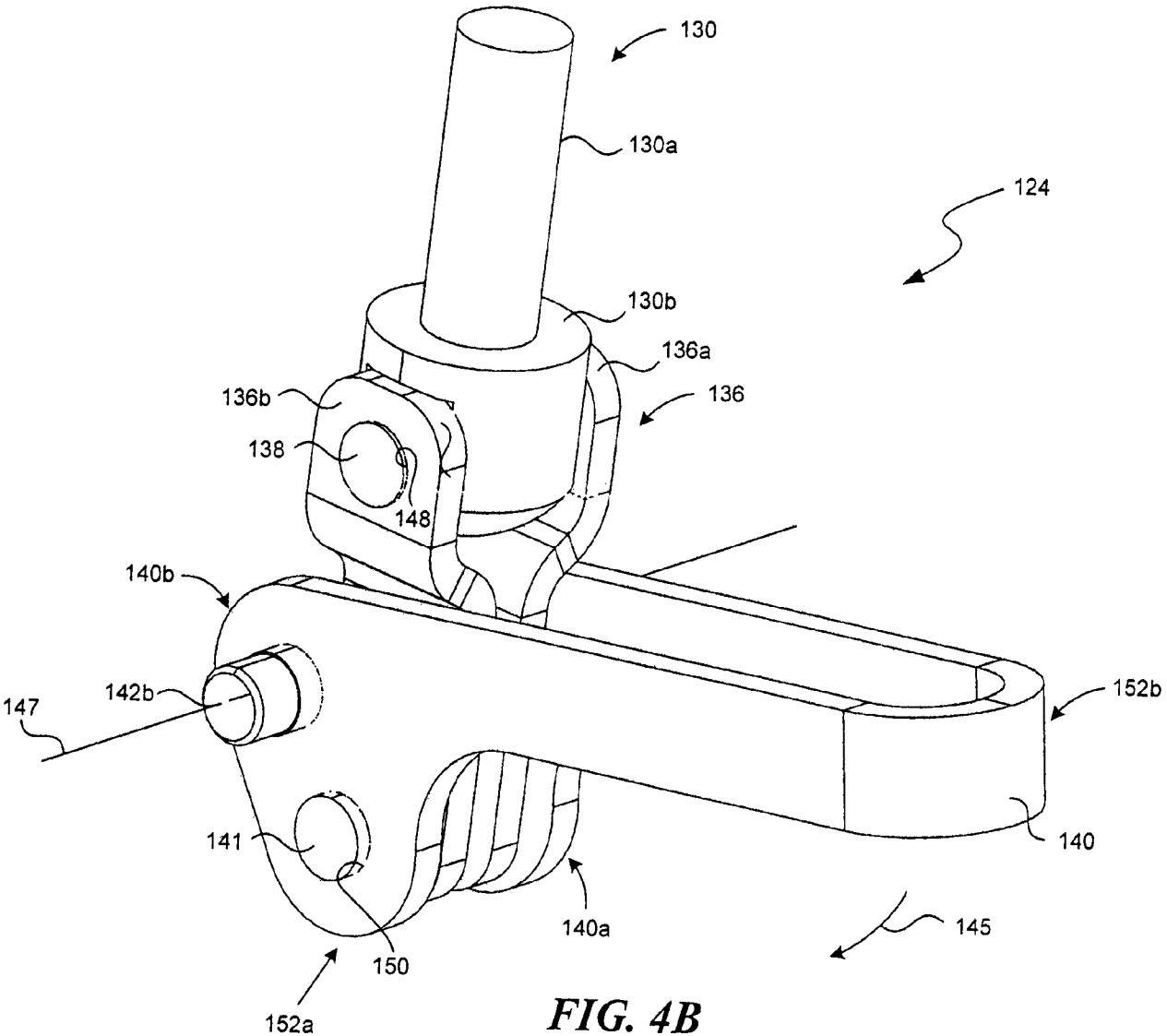

FIGS. 4A-B are isometric views of an embodiment of the latching subassembly 124 in FIG. 2 in accordance with an embodiment of the disclosure. As shown in FIGS. 4A-B, the latching subassembly 124 includes the attachment portion 136, the latching arm 140, and the coupling pin 141 pivotably coupling the attachment portion 136 and the latching arm 140 together.

The latching arm 140 includes first and second latching sections 140*a-b* spaced apart from one another and are eccentric relative to a latching axis 147 at a first end 152*a* proximate to the coupling pin 141. The latching arm 140 also includes a first latching pin 142*a* and a second latching pin 142*b* extending from the first and second latching sections 140*a-b*, respectively. The first and second latching sections 140*a-b* can be joined at a second end 152*b* spaced apart from the first end 152*a*. The attachment portion 136 can include a first attachment section 136*a* and a second attachment section 136*b* spaced apart from the first attachment section 136*a* at a distance suitable for accommodating the connector 130. Each of the first and second latching sections 140*a-b* and the first and second attachment sections 136*a-b* can include first apertures 150 that can be aligned along the latching axis 147 to allow the coupling pin 141 to extend through. The first and second attachment sections 136*a-b* can also include second apertures 148 that can be aligned to allow the swivel pin 138 to extend through. As a result, the latching arm 140 can pivot eccentrically relative to the attachment portion 136 around the latching axis 147, as indicated by the arrow 145.

Figure 5A:
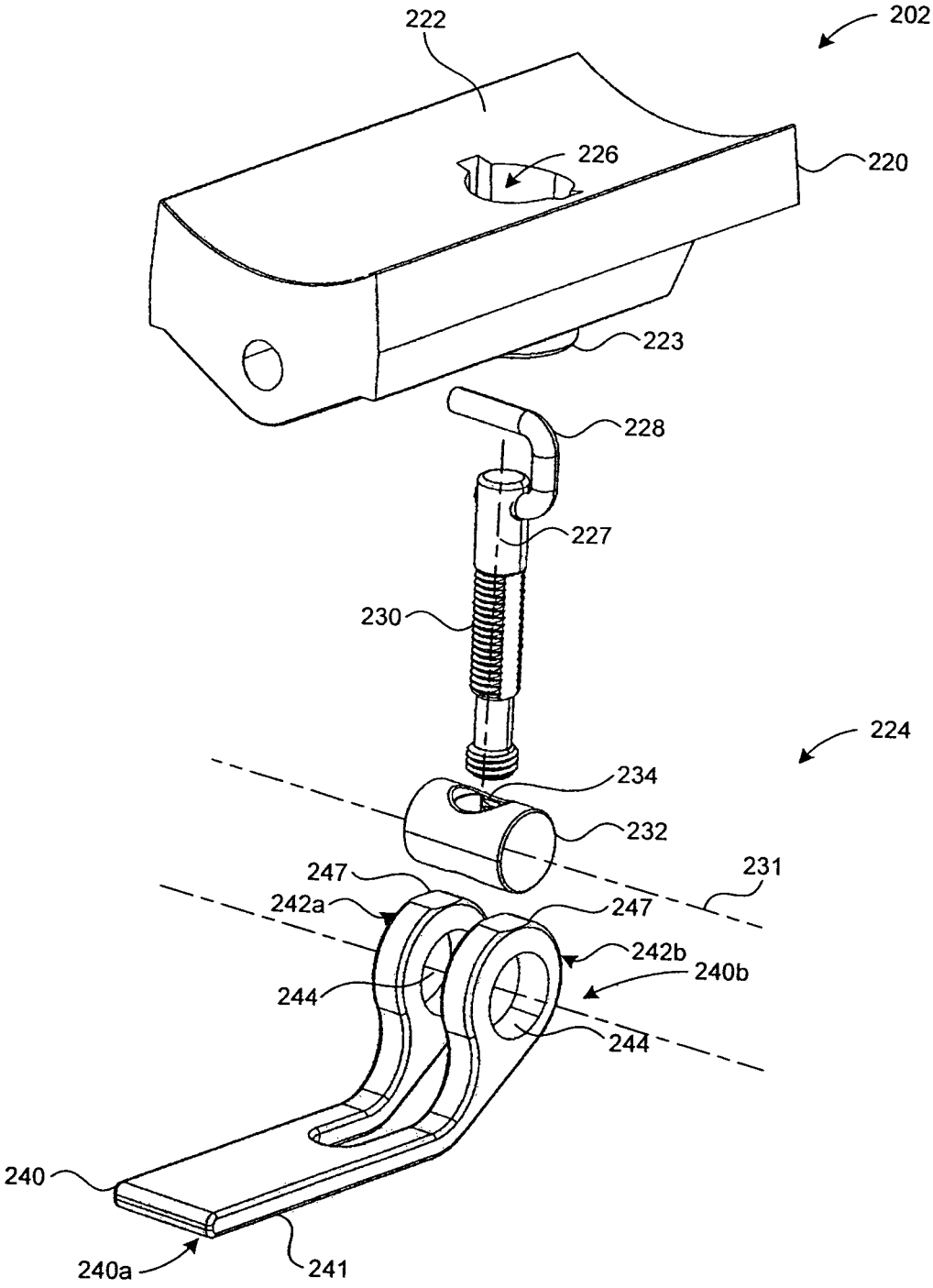
FIG. 5A is an exploded isometric view of an embodiment of an attachment mechanism suitable for use in the firearm assembly of FIG. 1 in accordance with another embodiment of the disclosure.

FIG. 5A is an exploded isometric view of an embodiment of an attachment mechanism 202 suitable for use in the firearm assembly 100 of FIG. 1 in accordance with another embodiment of the disclosure. The attachment mechanism 202 can include an interface member 220 and a latching subassembly 224 releasably coupled to the interface member 220.

The interface member 220 can include a first surface 222 that is curved to accommodate the stock 110 (FIG. 1) and a second surface 223 opposite the first surface 222 and proximate to the latching assembly 224. The interface member 220 can also include an interface aperture 226 extending from the first surface 222 to the second surface 223. As shown in FIG. 5A, The interface aperture 226 can have a generally circular cross-section with a stepped slot that extends radially outwardly. In other embodiments, the interface aperture 226 can have other cross-section configurations to accommodate the latching subassembly 224.

The latching subassembly 224 can include a attachment portion 228 fixedly or releasably attached to a threaded shaft 230. As shown in FIG. 5A, the attachment portion 228 includes a generally cylindrical bar that can engage the attachment portion 136 (FIG. 4A) by extending through the second apertures 148 (FIG. 4A). In other embodiments, the attachment portion 228 can also include a pin, a screw, and/or another fastening mechanism. In the illustrated embodiment, the threaded shaft 230 extends along a shaft axis 227 and has interrupted threads. In other embodiments, the threaded shaft 230 can have non-interrupted threads and/or other configurations.

The latching subassembly 224 can also include a bushing 232 having a threaded aperture 234 to engage the threaded shaft 230. In the illustrated embodiment, the bushing 232 has a generally cylindrical shape extending along a bushing axis 231. The threaded aperture 234 extends through the bushing 232 generally perpendicularly relative to the bushing axis 231. In other embodiments, the bushing 232 can having other configurations.

The latching subassembly 224 can further include a latching arm 240 releasably coupled to the bushing 232. The latching arm 240 includes a handle 241 at a first end 240*a* and first and second forks 242*a-b* spaced apart from one another and extending from the handle 241 toward a second end 240*b* opposite the first end 240*a*. The first and second forks 242*a-b* each include a cam structure 247 having an latching aperture 244 generally aligned along a latching axis 243 to receive the bushing 232. At least one of the cam structures 247 can be eccentric relative to the latching axis 243.

Figure 5B:
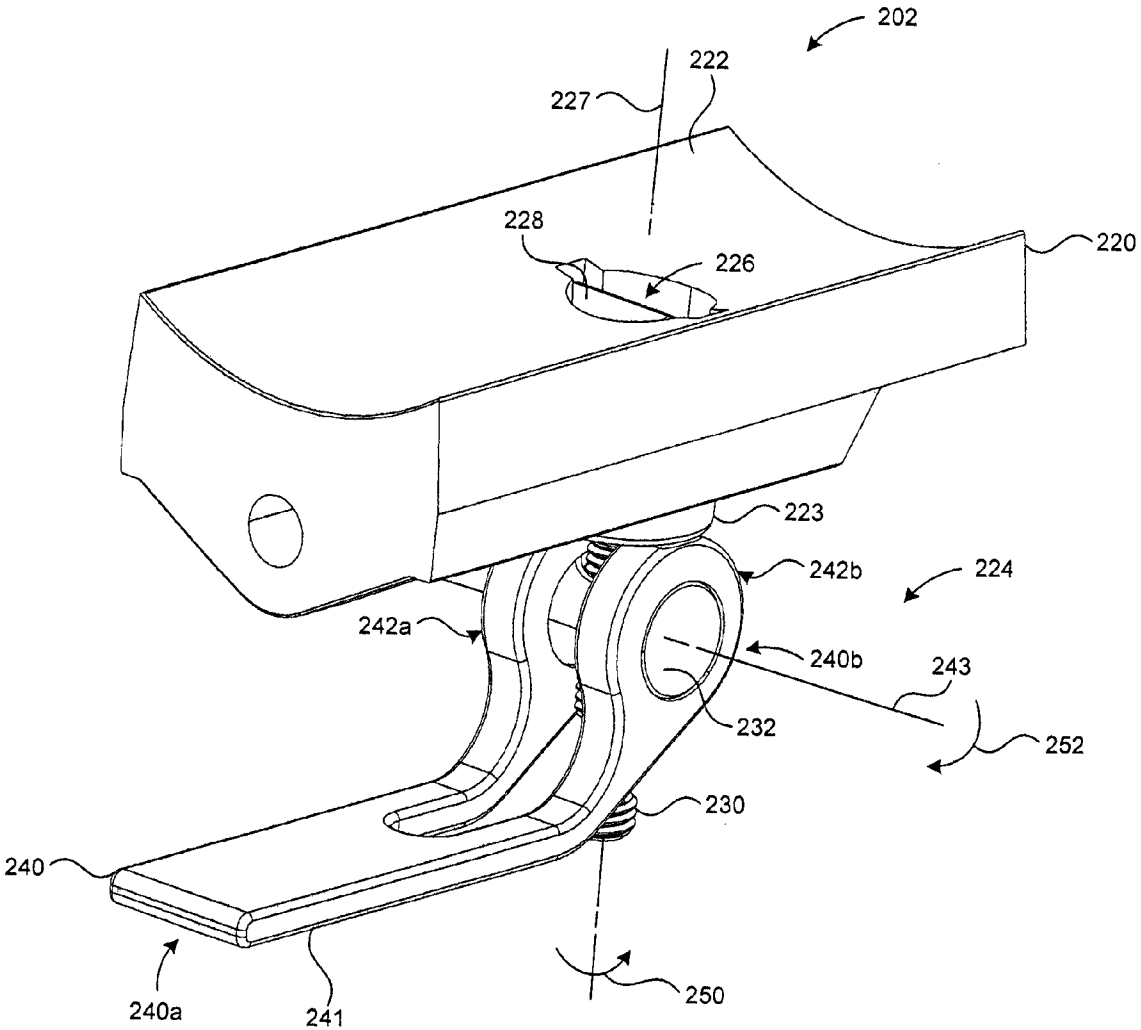
FIG. 5B is an isometric view of the attachment mechanism in FIG. 5A as assembled in accordance with another embodiment of the disclosure.

FIG. 5B is an isometric view of the attachment mechanism 202 in FIG. 5A as assembled in accordance with another embodiment of the disclosure. During assembly, the attachment portion 228 can be first engaged with the attachment portion 136 (FIG. 4A) by extending through the second apertures 148 (FIG. 4A). Then, the interface member 220 can be positioned against the stock 110 (FIG. 1) by having the threaded shaft 230 sliding through the interface aperture 226 until the attachment portion 228 rests on the stepped slot. Then, the threaded shaft 230 can extend through the bushing 232 that is received in the latching apertures 244 until the first and second forks 242*a-b* are proximate to the second surface 223 of the interface member 220. The latching arm 240 can then be rotated approximately 90° around the shaft axis 227 to engage threads of the threaded shaft 230. Then, the handle 241 can be rotated around the latching axis. As the latching arm 240 rotates, the cam structures 247 press against the second surface 223 of the interface member 220 to pull the stock 110 toward the bushing 232 in order to secure the attachment mechanism 202 to the stock 110.

In any of the embodiments discussed above, the attachment mechanisms can allows a user to attached/detach a support structure to/from a firearm without using tools and with improved attachment security over conventional techniques. According to conventional techniques, a threaded rod is typically used to couple to a swivel stud on a gun stock. A support structure (e.g., a bipod) is then attached to the stock and tightened by running a nut against the threaded rod. However, the motion of the bipod can cause the nut to come loose over time to undermine the attachment security. One conventional method to solve this problem is using tools to tighten the nut. However, such tools may not be available in the field. Embodiments of the attachment mechanisms solved this problem by using the latching arms with cam structures that can be rotated to exert resistance to the stock so that the bipod is less likely to come loose over time.

From the foregoing, it will be appreciated that specific embodiments of the invention have been described herein for purposes of illustration, but that various modifications may be made without deviating from the invention. Elements of one embodiment may be combined with other embodiments in addition to or in lieu of the elements of the other embodiments. Accordingly, the invention is not limited except as by the appended claims.

We claim:

1. An attachment mechanism for attaching a firearm to a support structure, comprising:

an interface member having an aperture and first side opposite a second side, wherein the first side is configured to contact the firearm; and a latching subassembly proximate to the interface member, the latching assembly including— an attachment portion configured to engage a connector extending from the firearm through the aperture; and a latching arm coupled to the attachment portion and movable about a latching axis, the latching arm having an end portion including a cam structure configured to contact the second side of the interface member, and wherein the cam structure has a latching aperture through which the latching axis passes, and wherein the cam structure is at least partially eccentric relative to the latching axis.

2. The attachment mechanism of claim 1 wherein the latching arm pivots about the latching axis from an open position to a closed position to lockably engage the second side of the interface member and to secure the first side of the interface member against the firearm.

3. The attachment mechanism of claim 1 wherein the attachment portion includes a shaft having a shaft axis extending longitudinally along the shaft, wherein the shaft axis is generally perpendicular to the latching axis.

4. The attachment mechanism of claim 1 wherein the cam structure includes a first cam structure spaced apart from a second cam structure.

5. The attachment mechanism of claim 4 wherein each of the first and second cam structures includes a generally flat portion that contacts the second side of the interface member to at least partially secure the interface member against the firearm when the latching arm is in a closed position with reference to the interface member.

6. The attachment mechanism of claim 4 wherein the latching subassembly further comprises a bushing coupled to the attachment portion, wherein the bushing at least partially extends through each of the first and second cam structures.

7. The attachment mechanism of claim 6 wherein the bushing is rotatably coupled to the shaft and rotates on the shaft, and wherein the latching arm is pivotally coupled to the bushing and the cam structure rotates on the bushing.

8. An attachment mechanism for attaching a firearm to a bipod, comprising:

an interface member having an aperture;

an attachment portion configured to releasably engage a stud extending from the firearm through the aperture;

a shaft having a first end portion coupled to the attachment portion and a second end portion opposite the first end portion, the shaft having a longitudinal axis;

a bushing coupled to the second end portion of the shaft; and a latching arm coupled to the bushing, wherein the latching arm moves about a latching axis between open and closed positions, wherein the latching axis is generally perpendicular to the longitudinal axis of the shaft, and wherein in the closed position the latching arm at least partially secures the interface member against the firearm wherein the latching arm includes a bushing opening that receives the bushing, and wherein the center of the bushing opening is eccentric with reference to the latching axis.

9. An attachment mechanism for attaching a firearm to a bipod, comprising:

an interface member having an aperture;

an attachment portion configured to releasably engage a stud extending from the firearm through the aperture;

a shaft having a first end portion coupled to the attachment portion and a second end portion opposite the first end portion, the shaft having a longitudinal axis;

a bushing coupled to the second end portion of the shaft; and a latching arm coupled to the bushing, wherein the latching arm moves about a latching axis between open and closed positions, wherein the latching axis is generally perpendicular to the longitudinal axis of the shaft, and wherein in the closed position the latching arm at least partially secures the interface member against the firearm, wherein the latching arm includes a cam structure that rotates about the bushing, and wherein the cam structure includes a generally planar section that contacts the second surface of the interface member when the latching arm is in the closed position.

10. An attachment mechanism for attaching a firearm to a bipod, comprising:

an interface member having an aperture;

an attachment portion configured to releasably engage a stud extending from the firearm through the aperture;

a shaft having a first end portion coupled to the attachment portion and a second end portion opposite the first end portion, the shaft having a longitudinal axis;

a bushing coupled to the second end portion of the shaft; and a latching arm coupled to the bushing, wherein the latching arm moves about a latching axis between open and closed positions, wherein the latching axis is generally perpendicular to the longitudinal axis of the shaft, and wherein in the closed position the latching arm at least partially secures the interface member against the firearm wherein the latching arm includes a first cam portion spaced apart from a second cam portion, and wherein the bushing extends laterally between the first cam portion and the second cam portion.

11. The attachment assembly of claim 10 wherein the shaft extends at least partially through the bushing in between the first cam portion and the second cam portion.

12. An attachment mechanism for attaching a firearm to a bipod, comprising:

an interface member having an aperture;

an attachment portion configured to releasably engage a stud extending from the firearm through the aperture;

a shaft having a first end portion coupled to the attachment portion and a second end portion opposite the first end portion, the shaft having a longitudinal axis;

a bushing coupled to the second end portion of the shaft wherein the bushing includes a threaded opening that receives a threaded portion of the shaft; and a latching arm coupled to the bushing, wherein the latching arm moves about a latching axis between open and closed positions, wherein the latching axis is generally perpendicular to the longitudinal axis of the shaft, and wherein in the closed position the latching arm at least partially secures the interface member against the firearm.

13. An attachment mechanism for attaching a firearm to a bipod, comprising:

an interface member having an aperture;

an attachment portion configured to releasably engage a stud extending from the firearm through the aperture;

a shaft having a first end portion coupled to the attachment portion and a second end portion opposite the first end portion, the shaft having a longitudinal axis;

a bushing coupled to the second end portion of the shaft wherein the bushing rotates on the shaft about the longitudinal axis, and the latching arm rotates on the bushing about the latching axis; and a latching arm coupled to the bushing, wherein the latching arm moves about a latching axis between open and closed positions, wherein the latching axis is generally perpendicular to the longitudinal axis of the shaft, and wherein in the closed position the latching arm at least partially secures the interface member against the firearm.

14. An attachment assembly for securing a firearm to a support structure, the attachment assembly comprising:

an interface member configured to contact the firearm, the interface member having an aperture configured to receive a connector extending from the firearm; and a latching subassembly including— an attachment portion configured to releasably engage the connector;

a shaft extending from the attachment portion; and a latching arm coupled to the shaft, wherein the latching arm includes a handle at a first end portion and first and second spaced apart forks at a second end portion, and wherein the shaft extends at least partially between the first and second forks wherein the latching arm pivots about a latching axis that is generally perpendicular to the longitudinal axis of the shaft.

15. The attachment assembly of claim 14, further comprising a bushing attached to the shaft, wherein the bushing extends through each of the first and second forks.

16. The attachment assembly of claim 15 wherein the latching arm rotates on the bushing about a latching axis, and wherein each of the first and second forks is eccentric relative to the latching axis.

17. The attachment assembly of claim 14 wherein each of the first and second forks includes a generally flat portion that contacts the interface member to lock the latching subassembly when the latching arm is moved to a closed position with reference to the interface member.

18. The attachment assembly of claim 14 wherein the latching subassembly further comprises a bushing coupled to the shaft and spaced apart from the attachment portion, wherein the bushing extends through at least a portion of the first fork and the second fork.

* * * * *